US006594626B2

(12) United States Patent
Suzuki et al.

(10) Patent No.: US 6,594,626 B2
(45) Date of Patent: Jul. 15, 2003

(54) VOICE ENCODING AND VOICE DECODING USING AN ADAPTIVE CODEBOOK AND AN ALGEBRAIC CODEBOOK

(75) Inventors: Masanao Suzuki, Kawasaki (JP); Yasuji Ota, Kawasaki (JP); Yoshiteru Tsuchinaga, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/046,125

(22) Filed: Jan. 8, 2002

(65) Prior Publication Data

US 2002/0111800 A1 Aug. 15, 2002

Related U.S. Application Data

(63) Continuation of application No. PCT/JP99/04991, filed on Sep. 14, 1999.

(51) Int. Cl.[7] ..... G10L 19/04

(52) U.S. Cl. ..... 704/220; 704/264; 704/265; 704/223; 704/207; 704/262

(58) Field of Search ..... 704/220, 207, 704/205, 206, 219, 223, 262, 263, 264, 266, 265

(56) References Cited

U.S. PATENT DOCUMENTS

| | | | | | |
|---|---|---|---|---|---|
| 5,396,576 | A | * | 3/1995 | Miki et al. | 704/222 |
| 5,581,652 | A | * | 12/1996 | Abe et al. | 704/222 |
| 5,684,920 | A | * | 11/1997 | Iwakami et al. | 704/203 |
| 5,701,392 | A | | 12/1997 | Adoul et al. | |
| 5,717,825 | A | | 2/1998 | Lamblin | |
| 5,732,188 | A | * | 3/1998 | Moriya et al. | 704/219 |
| 5,754,976 | A | | 5/1998 | Adoul et al. | |
| 5,787,391 | A | * | 7/1998 | Moriya et al. | 704/225 |
| 6,014,618 | A | * | 1/2000 | Patel et al. | 704/207 |
| 6,073,092 | A | * | 6/2000 | Kwon | 704/219 |
| 6,295,520 | B1 | * | 9/2001 | Tian | 704/223 |
| 6,330,533 | B2 | * | 12/2001 | Su et al. | 704/220 |
| 6,330,535 | B1 | * | 12/2001 | Yasunaga et al. | 704/223 |
| 6,345,246 | B1 | * | 2/2002 | Moriya et al. | 704/219 |

FOREIGN PATENT DOCUMENTS

| | | | | |
|---|---|---|---|---|
| EP | 0 409 239 | A2 * | 1/1991 | G10L/9/14 |
| EP | 0 443 548 | A2 * | 8/1991 | G10L/9/14 |
| EP | 0 577 488 | A1 * | 5/1994 | G10L/9/14 |
| EP | 0 657 874 | A1 * | 6/1995 | G10L/9/18 |
| JP | 05019795 | | 1/1993 | |
| JP | 05173596 | | 7/1993 | |
| JP | 05346798 | | 12/1993 | |
| JP | 07056599 | | 3/1995 | |
| JP | 07092999 | | 4/1995 | |
| JP | 05167457 | | 7/1996 | |
| JP | 10133696 | | 5/1998 | |
| JP | 10232696 | | 9/1998 | |

* cited by examiner

*Primary Examiner*—Vijay Chawan
(74) *Attorney, Agent, or Firm*—Katten Muchin Zavis Rosenman

(57) ABSTRACT

Disclosed is a voice encoding method having a synthesis filter implemented using linear prediction coefficients obtained by dividing an input signal into frames each of a fixed length, and subjecting the input signal to linear prediction analysis in the frame units, generating a reconstructed signal by driving said synthesis filter by a periodicity signal output from an adaptive codebook and a pulsed signal output from an algebraic codebook, and performing encoding in such a manner that an error between the input signal and said reproduced signal is minimized, wherein there are provided an encoding mode 1 that uses pitch lag obtained from an input signal of a present frame and an encoding mode 2 that uses pitch lag obtained from an input signal of a past frame. Encoding is performed in encoding mode 1 and encoding mode 2, the mode in which the input signal can be encoded more precisely is decided frame by frame and encoding is carried out on the basis of the mode decided.

15 Claims, 19 Drawing Sheets

FIG. 2

| PULSE SYSTEM | PULSE POSITION |
|---|---|
| 0 | 0, 5, 10, 15, 20, 25, 30, 35, 40, 45, 50, 55, 60, 65, 70, 75 |
| 1 | 1 , 6, 11, 16, 21, 26, 31, 36, 41, 46, 51, 56, 61, 66, 71, 76<br>2 , 7, 12, 17, 22, 27, 32, 37, 42, 47, 52, 57, 62, 67, 72, 77 |
| 2 | 3 , 8, 13, 18, 23, 28, 33, 38, 43, 48, 53, 58, 63, 68, 73, 78<br>4 , 9, 14, 19, 24, 29, 34, 39, 44, 49, 54, 59, 64, 69, 74, 79 |

FIG. 3

| PULSE SYSTEM | PULSE POSITION |
|---|---|
| 0 | 0 , 5, 10, 15, 20, 25, 30, 35, 40, 45, 50, 55, 60, 65, 70, 75 |
| 1 | 1 , 6, 11, 16, 21, 26, 31, 36, 41, 46, 51, 56, 61, 66, 71, 76 |
| 2 | 2 , 7, 12, 17, 22, 27, 32, 37, 42, 47, 52, 57, 62, 67, 72, 77 |
| 3 | 3 , 8, 13, 18, 23, 28, 33, 38, 43, 48, 53, 58, 63, 68, 73, 78 |
| 4 | 4 , 9, 14, 19, 24, 29, 34, 39, 44, 49, 54, 59, 64, 69, 74, 79 |

FIG. 5

| PULSE SYSTEM | PULSE POSITION |
|---|---|
| 0 | 0, 7, 14, 21, 28, 35, 42, 49 |
| 1 | 1, 8, 15, 22, 29, 36, 43, 50 |
| 2 | 2, 9, 16, 23, 30, 37, 44, 51 |
| 3 | 3, 10, 17, 24, 31, 38, 45, 52 |
| 4 | 4, 11, 18, 25, 32, 39, 46, 53 |
| 5 | 5, 12, 19, 26, 33, 40, 47, 54<br>6, 13, 20, 27, 34, 41, 48, 55 |

FIG.10(a)

| PULSE SYSTEM | PULSE POSITION |
|---|---|
| 0 | 0, 5, 10, 15, 20, 25, 30, 35, 40, 45, 50, 55, 60, 65, 70, 75 |
| 1 | 1, 6, 11, 16, 21, 26, 31, 36, 41, 46, 51, 56, 61, 66, 71, 76<br>2, 7, 12, 17, 22, 27, 32, 37, 42, 47, 52, 57, 62, 67, 72, 77 |
| 2 | 3, 8, 13, 18, 23, 28, 33, 38, 43, 48, 53, 58, 63, 68, 73, 78<br>4, 9, 14, 19, 24, 29, 34, 39, 44, 49, 54, 59, 64, 69, 74, 79 |

FIG.10(b)

| PULSE SYSTEM | PULSE POSITION |
|---|---|
| 0 | 0, 5, 10, 15, 20, 25, 30, 35, 40, 45, 50, 55, 60, 65, 70, 75 |
| 1 | 1, 6, 11, 16, 21, 26, 31, 36, 41, 46, 51, 56, 61, 66, 71, 76 |
| 2 | 2, 7, 12, 17, 22, 27, 32, 37, 42, 47, 52, 57, 62, 67, 72, 77 |
| 3 | 3, 8, 13, 18, 23, 28, 33, 38, 43, 48, 53, 58, 63, 68, 73, 78 |
| 4 | 4, 9, 14, 19, 24, 29, 34, 39, 44, 49, 54, 59, 64, 69, 74, 79 |

FIG.10(C)

| PULSE SYSTEM | PULSE POSITION |
|---|---|
| 0 | 0, 7, 14, 21, 28, 35, 42, 49 |
| 1 | 1, 8, 15, 22, 29, 36, 43, 50 |
| 2 | 2, 9, 16, 23, 30, 37, 44, 51 |
| 3 | 3, 10, 17, 24, 31, 38, 45, 52 |
| 4 | 4, 11, 18, 25, 32, 39, 46, 53 |
| 5 | 5, 12, 19, 26, 33, 40, 47, 54<br>6, 13, 20, 27, 34, 41, 48, 55 |

FIG. 18

PRIOR ART

| PULSE SYSTEM | PULSE POSITION |
|---|---|
| 1 | 0, 5, 10, 15, 20, 25, 30, 35 |
| 2 | 1, 6, 11, 16, 21, 26, 31, 36 |
| 3 | 2, 7, 12, 17, 22, 27, 32, 37 |
| 4 | 3, 8, 13, 18, 23, 28, 33, 38<br>4, 9, 14, 19, 24, 29, 34, 39 |

FIG. 20

PRIOR ART

| PULSE SYSTEM | PULSE POSITION |
|---|---|
| 1 | 0, 5, 10, 15, 20, 25, 30, 35, 40, 45, 50, 55, 60, 65, 70, 75 |
| 2 | 1, 6, 11, 16, 21, 26, 31, 36, 41, 46, 51, 56, 61, 66, 71, 76 |
| 3 | 2, 7, 12, 17, 22, 27, 32, 37, 42, 47, 52, 57, 62, 67, 72, 77 |
| 4 | 3, 8, 13, 18, 23, 28, 33, 38, 43, 48, 53, 58, 63, 68, 73, 78<br>4, 9, 14, 19, 24, 29, 34, 39, 44, 49, 54, 59, 64, 69, 74, 79 |

FIG. 21

PRIOR ART

| PULSE SYSTEM | PULSE POSITION |
|---|---|
| 0 | 0, 5, 10, 15, 20, 25, 30, 35, 40, 45, 50, 55, 60, 65, 70, 75 |
| 1 | 1, 6, 11, 16, 21, 26, 31, 36, 41, 46, 51, 56, 61, 66, 71, 76<br>2, 7, 12, 17, 22, 27, 32, 37, 42, 47, 52, 57, 62, 67, 72, 77 |
| 2 | 3, 8, 13, 18, 23, 28, 33, 38, 43, 48, 53, 58, 63, 68, 73, 78<br>4, 9, 14, 19, 24, 29, 34, 39, 44, 49, 54, 59, 64, 69, 74, 79 |

VOICE ENCODING AND VOICE DECODING USING AN ADAPTIVE CODEBOOK AND AN ALGEBRAIC CODEBOOK

This is a continuation of PCT/JP99/04991 filed Sep. 14, 1999.

BACKGROUND OF THE INVENTION

This invention relates to a voice encoding and voice decoding apparatus for encoding/decoding voice at a low bit rate of below 4 kbps. More particularly, the invention relates to a voice encoding and voice decoding apparatus for encoding/decoding voice at low bit rates using an A-b-S (Analysis-by-Synthesis)-type vector quantization. It is expected that A-b-S voice encoding typified by CELP (Code Excited Linear Predictive Coding) will be an effective scheme for implementing highly efficient compression of information while maintaining speech quality in digital mobile communications and intercorporate communications systems.

In the field of digital mobile communications and intercorporate communications systems at the present time, it is desired that voice in the telephone band (0.3 to 3.4 kHz) be encoded at a transmission rate on the order of 4 kbps. The scheme referred to as CELP (Code Excited Linear Prediction) is seen as having promise in filling this need. For details on CELP, see M. R. Schroeder and B. S. Atal, "Code-Excited Linear Prediction (CELP): High-Quality Speech at Very Low Bit Rates," Proc. ICASSP'85, 25.1.1, pp. 937–940, 1985. CELP is characterized by the efficient transmission of linear prediction coefficients (LPC coefficients), which represent the speech characteristics of the human vocal tract, and parameters representing a sound-source signal comprising the pitch component and noise component of speech.

FIG. 15 is a diagram illustrating the principles of CELP. In accordance with CELP, the human vocal tract is approximated by an LPC synthesis filter H(z) expressed by the following equation:

$$H(z) = \frac{1}{1 + \sum_{i=1}^{p} a_i z^{-i}} \tag{1}$$

and it is assumed that the input (sound-source signal) to H(z) can be separated into (1) a pitch-period component representing the periodicity of speech and (2) a noise component representing randomness. CELP, rather than transmitting the input voice signal to the decoder side directly, extracts the filter coefficients of the LPC synthesis filter and the pitch-period component and noise component of the excitation signal, quantizes these to obtain quantization indices and transmits the quantization indices, thereby implementing a high degree of information compression.

When the voice signal is sampled at a predetermined speed in FIG. 15, input signals (voice signals) X of a predetermined number (=N) of samples per frame are input to an LPC analyzer 1 frame by frame. If the sampling speed is 8 kHz and the period of a single frame is 10 ms, then one frame is composed of 80 samples.

The LPC analyzer 1, which is regarded as an all-pole filter represented by Equation (1), obtains filter coefficients $\alpha_i$ (i=1, . . . , p), where p represents the order of the filter. Generally, in the case of voice in the telephone band, a value of 10 to 12 is used as p. LPC coefficients $\alpha_i$ (i=1, . . . , p) are quantized by scalar quantization or vector quantization in an LPC-coefficient quantizer 2, after which the quantization indices are transmitted to the decoder side. FIG. 16 is a diagram useful in describing the quantization method. Here sets of large numbers of quantization LPC coefficients have been stored in a quantization table 2*a* in correspondence with index numbers 1 to n. A distance calculation unit 2*b* calculates distance in accordance with the following equation:

$$d = W \cdot \Sigma_i \{\alpha_q(i) - \alpha_i\}^2 \ (i=1 \sim p)$$

When q is varied from 1 to n, a minimum-distance index detector 2*c* finds the q for which the distance d is minimum and sends the index q to the decoder side. In this case, an LPC synthesis filter constituting an auditory weighting synthesis filter 3 is expressed by the following equation:

$$H_q(z) = \frac{1}{1 + \sum_{i=1}^{p} \alpha_i(i) z^{-i}} \tag{2}$$

Next, quantization of the sound-source signal is carried out. In accordance with CELP, a sound-source signal is divided into two components, namely a pitch-period component and a noise component, an adaptive codebook 4 storing a sequence of past sound-source signals is used to quantize the pitch-period component and an algebraic codebook or noise codebook is used to quantize the noise component. Described below will be typical CELP-type voice encoding using the adaptive codebook 4 and algebraic codebook 5 as sound-source codebooks.

The adaptive codebook 4 is adapted to successively output N samples of sound-source signals (referred to as "periodicity signals"), which are delayed by one pitch (one sample), in association with indices 1 to L. FIG. 17 is a diagram showing the structure of the adaptive codebook 4 in case of L=147, one frame, 80 samples (N=80). The adaptive codebook is constituted by a buffer BF for storing the pitch-period component of the latest 227 samples. A periodicity signal comprising 1 to 80 samples is specified by index 1, a periodicity signal comprising 2 to 81 samples is specified by index 2, . . . , and a periodicity signal comprising 147 to 227 samples is specified by index 147.

An adaptive-codebook search is performed in accordance with the following procedure: First, a bit lag L representing lag from the present frame is set to an initial value $L_0$ (e.g., 20). Next, a past periodicity signal (adaptive code vector) $P_L$, which corresponds to the lag L, is extracted from the adaptive codebook 4. That is, an adaptive code vector $P_L$ indicated by index L is extracted and $P_L$ is input to the auditory weighting synthesis filter 3 to obtain an output $AP_L$, where A represents the impulse response of the auditory weighting synthesis filter 3 constructed by cascade connecting an auditory weighting filter W(z) and an LPC synthesis filter Hq(z).

Any filter can be used as the auditory weighting filter. For example, it is possible to use a filter having the characteristic indicated by the following equation:

$$W(z) = \frac{1 + \sum_{i=1}^{m} g_1^i \alpha_i z^{-1}}{1 + \sum_{i=1}^{m} g_2^i \alpha_i z^{-1}} \tag{3}$$

where $g_1$, $g_2$ are parameters for adjusting the characteristic of the weighting filter.

An arithmetic unit 6 finds an error power $E_L$ between the input voice and $AP_L$ in accordance with the following equation:

$$E_L=|X-\beta AP_L|^2 \tag{4}$$

If we let $AP_L$ represent a weighted synthesized output from the adaptive codebook, Rpp the autocorrelation of $AP_L$ and Rxp the cross-correlation between $AP_L$ and the input signal X, then an adaptive code vector $P_L$ at a pitch lag Lopt for which the error power of Equation (4) is minimum will be expressed by the following equation:

$$P_L = \arg\max\left(\frac{R^2xp}{Rpp}\right) = \arg\max\left[\frac{(X^TAP_L)^2}{(AP_L)^T(AP_L)}\right] \tag{5}$$

where T signifies a transposition. Accordingly, an error-power evaluation unit 7 finds the pitch lag Lopt that satisfies Equation (5). Optimum pitch gain βopt is given by the following equation:

$$\beta opt=Rxp/Rpp \tag{6}$$

Though the search range of lag L is optional, the lag range can be made 20 to 147 in a case where the sampling frequency of the input signal is 8 kHz.

Next, the noise component contained in the sound-source signal is quantized using the algebraic codebook 5. The algebraic codebook 5 is constituted by a plurality of pulses of amplitude 1 or −1. By way of example, FIG. 18 illustrates pulse positions for a case where frame length is 40 samples. The algebraic codebook 5 divides the N (=40) sampling points constituting one frame into a plurality of pulse-system groups 1 to 4 and, for all combinations obtained by extracting one sampling point from each of the pulse-system groups, successively outputs, as noise components, pulsed signals having a +1 or a −1 pulse at each extracted sampling point. In this example, basically four pulses are deployed per frame. FIG. 19 is a diagram useful in describing sampling points assigned to each of the pulse-system groups 1 to 4.

(1) Eight sampling points 0, 5, 10, 15, 20, 25, 30, 35 are assigned to the pulse-system group 1;

(2) eight sampling points 1, 6, 11, 16, 21, 26, 31, 36 are assigned to the pulse-system group 2;

(3) eight sampling points 2, 7, 12, 17, 22, 27, 32, 37 are assigned to the pulse-system group 3; and (4) 16 sampling points 3, 4, 8, 9, 13, 14, 18, 19, 23, 24, 28, 29, 33, 34, 38, 39 are assigned to the pulse-system group 4.

Three bits are required to express one of the sampling points in pulse-system groups 1 to 3 and one bit is required to express the sign of a pulse, for a total of four bits. Further, four bits are required to express one of the sampling points in pulse-system group 4 and one bit is required to express the sign of a pulse, for a total of five bits. Accordingly, 17 bits are necessary to specify a pulsed signal output from the algebraic codebook 5 having the pulse placement of FIG. 18, and $2^{17}$ ($=2^4\times2^4\times2^4\times2^5$) types of pulsed signals exist.

The algebraic codebook search will now be described with regard to this example. The pulse positions of each of the pulse systems group are limited as illustrated in FIG. 18. In the algebraic codebook search, a combination of pulses for which the error power relative to the input voice is minimized in the reconstruction region is decided from among the combinations of pulse positions of each of the pulse systems. More specifically, with βopt as the optimum pitch gain found by the adaptive codebook search, the output PL of the adaptive codebook is multiplied by the gain βopt and the product is input to an adder 8. At the same time, the pulsed signals are input successively to the adder 8 from the algebraic codebook 5 and a pulsed signal is specified that will minimize the difference between the input signal X and a reconstructed signal obtained by inputting the adder output to the weighting synthesis filter 3.

More specifically, first a target vector X' for an algebraic codebook search is generated in accordance with the following equation from the optimum adaptive codebook output $P_L$ and optimum pitch gain βopt obtained from the input signal X by the adaptive codebook search:

$$X'=X-\beta optAP_L \tag{7}$$

In this example, pulse position and amplitude (sign) are expressed by 17 bits and therefore $2^{17}$ combinations exist, as mentioned above. Accordingly, letting $C_K$ represent a kth algebraic-code output vector, a code vector $C_K$ that will minimize an evaluation-function error output power D in the following equation is found by a search of the algebraic codebook:

$$D=|X'-\gamma AC_K|^2 \tag{8}$$

where γ represents the gain of the algebraic codebook. Minimizing Equation (8) is equivalent to finding the $C_K$, i.e., the k, that will minimize the following equation:

$$D' = \frac{(X'^TAC_k)^2}{(AC_k)^T(AC_k)} \tag{9}$$

The error-power evaluation unit 7 searches for k as set forth below.

If we let $\Phi=A^TA$, $d=X'^TA$ hold, then the above will be expressed as follows:

$$D' = \frac{(dC_k)^2}{C_k^T\Phi C_k} = \frac{Q_k^2}{E_k} \tag{10}$$

If we let the elements of the impulse response be a(0), a(1), . . . , a(N−1) and let the elements of the target signal X' be x' (0), x' (1), . . . , x' (N−1), then d will be expressed by the following equation, where N is the frame length:

$$d(n) = \sum_{i=n}^{N-1} x'(i)a(i-n),\ n = 0, \ldots, N-1 \tag{11}$$

Further, an element φ(i,j) of Φ is represented by the following equation:

$$\phi(i, j) = \sum_{n=j}^{N-1} a(n-i)a(n-j), \quad i = 0 \ldots, N-1,\ j = i, \ldots, N-1 \tag{12}$$

It should be noted that d(n) and φ(i,j) are calculated before the search of the algebraic codebook.

If we let Np represent the number of pulses contained in the output vector $C_k$ of the algebraic codebook 5, then $Q_k$ in the numerator of Equation (1) is represented by the following equation:

$$Q_k = \sum_{i=0}^{N-1} s_k(i) d[m_k(i)] \tag{13}$$

where $S_k(i)$ is the pulse amplitude (+1 or −1) in the ith pulse system of $C_k$ and $m_k(i)$ represents the position of the pulse. Further, the denominator $E_k$ of Equation (10) is found by the following equation:

$$E_k = \sum_{i=0}^{N-1} \phi[m_k(i), m_k(i)] + 2\sum_{i=0}^{N-2} \sum_{j=i+1}^{N-1} s_k(i) s_k(j) \phi[m_k(i), m_k(j)] \tag{14}$$

It is also possible to conduct a search using $Q_k$ in Equation (13) and $E_k$ in Equation (14). However, in order to reduce the amount of processing involved in the search, $Q_k$ and $E_k$ are transformed through the following procedure: First, d(n) is split into two portions, namely its absolute value |d(n)| and sign sign[d(n)]. Next, the sign information of d(n) is included in Φ by the following equation:

$$\phi'(i,j) = \text{sign}[d(i)]\text{sign}[d(j)]\phi(i,j),\ i=0, \ldots N-1,\ j=i+1, \ldots N-1 \tag{15}$$

In order to eliminate the constant 2 in the second term of Equation (14), the main diagonal component of Φ is scaled by the following equation:

$$\phi'(i,i) = \phi'(i,i)/2,\ i=0, \ldots N-1 \tag{16}$$

Accordingly, the numerator $Q_k$ is simplified as indicated by the following equation:

$$Q'_k = \sum_{i=0}^{N-1} |d[m_k(i)]| \tag{17}$$

Further, the denominator $E_k$ is simplified as indicated by the following equation:

$$E'_k = E_k/2 \tag{18}$$

$$= \sum_{i=0}^{N-1} \phi'[m_k(i), m_k(i)] + \sum_{i=0}^{N-2} \sum_{j=i+1}^{N-1} s_k(i) s_k(j) \phi'[m_k(i), m_k(j)]$$

Accordingly, the output of the algebraic codebook can be obtained by calculating the numerator $Q_k'$ and denominator $E_k'$ in accordance with Equations (17), (18) while changing the position of each pulse, and deciding the pulse position for which $D'' = Q_k'^2/E_k'$ is maximized.

Next, quantization of the gains βopt, γopt is carried out. The gain quantization method is optional and a method such as scalar quantization or vector quantization can be used. For example, it is so arranged that β, γ are quantized and the quantization indices of the gain are transmitted to the decoder through a method similar to that employed by the LPC-coefficient quantizer 2.

Thus, an output information selector 9 sends the decoder (1) the quantization index of the LPC coefficient, (2) pitch lag Lopt, (3) an algebraic codebook index (pulsed-signal specifying data), and (4) a quantization index of gain.

Further, after all search processing and quantization processing in the present frame is completed, and before the input signal of the next frame is processed, the state of the adaptive codebook 4 is updated. In state updating, a frame length of the sound-source signal of the oldest frame (the frame farthest in the past) in the adaptive codebook is discarded and a frame length of the latest sound-source signal found in the present frame is stored. It should be noted that the initial state of the adaptive codebook 4 is the zero state, i.e., a state in which the amplitudes of all samples are zero.

Thus, as described above, the CELP system produces a model of the speech generation process, quantizes the characteristic parameters of this model and transmits the parameters, thereby making it possible to compress speech efficiently.

It is known that CELP (and improvements therein) makes it possible to realize high-quality reconstructed speech at a bit rate on the order of 8 to 16 kbps. Among these schemes, ITU-T Recommendation G.729A (CS-ACELP) makes it possible to achieve a sound quality equal to that of 32-kbps ADPCM on the condition of a low bit rate of 8 kbps. From the standpoint of effective utilization of the communication channel, however, there is now a need to implement high-quality reconstructed speech at a very low bit rate of less than 4 kbps.

The simplest method of reducing bit rate is to raise the efficiency of vector quantization by increasing frame length, which is the unit of encoding. The CS-ACELP frame length is 5 ms (40 samples) and, as mentioned above, the noise component of the sound-source signal is vector-quantized at 17 bits per frame. Consider a case where frame length is made 10 ms (=80 samples), which is twice that of CS-ACELP, and the number of quantization bits assigned to the algebraic codebook per frame is 17.

FIG. 20 illustrates an example of pulse placement in a case where four pulses reside in a 10-ms frame. The pulses (sampling points and polarities) of first to third pulse systems in FIG. 20 are each represented by five bits and the pulses of a fourth pulse system are represented by six bits, so that 21 bits are necessary to express the indices of the algebraic codebook. That is, in a case where the algebraic codebook is used, if frame length is simply doubled to 10 ms, the combinations of pulses increase by an amount commensurate with the increase in positions at which pulses reside unless the number of pulses per frame is reduced. As a consequence, the number of quantization bits also increases.

In the case of this example, the only method available to make the number of bits of the algebraic codebook indices equal to 17 is to reduce the number of pulses, as illustrated in FIG. 21 by way of example. However, on the basis of experiments performed by the Inventor, it has been found that the quality of reconstructed speech deteriorates markedly when the number of pulses per frame is made three or less. This phenomenon can be readily understood qualitatively. Specifically, if there are four pulses per frame (FIG. 18) in a case where the frame length is 5 ms, then eight pulses will be present in 10 ms. By contrast, if there are three pulses per frame (FIG. 21) in a case where the frame length is 10 ms, then naturally only three pulses will be present in 10 ms. As a consequence, the noise property of the sound-source signal to be represented in the algebraic codebook cannot be expressed and the quality of reconstructed speech declines.

Thus, even if frame length is enlarged to reduce the bit rate, the bit rate cannot be reduced unless the number of pulses per frame is reduced. If the number of pulses is reduced, however, the quality of reconstructed speech deteriorates by a wide margin. Accordingly, with the method of raising the efficiency of vector quantization simply by increasing frame length, achieving high-quality reconstructed speed at a bit rate of 4 kbps is difficult.

SUMMARY OF THE INVENTION

Accordingly, an object of the present invention is to make it possible to reduce the bit rate and reconstruct high-quality speech.

In CELP, an encoder sends a decoder (1) a quantization index of an LPC coefficient, (2) pitch lag Lopt of an adaptive codebook, (3) an algebraic codebook index (pulsed-signal specifying data), and (4) a quantization index of gain. In this case, eight bits are necessary to transmit the pitch lag. If pitch lag need not be sent, therefore, the number of bits used to express the algebraic codebook index can be increased commensurately. In other words, the number of pulses contained in the pulsed signal output from the algebraic codebook can be increased and it therefore becomes possible to transmit high-quality voice code and to achieve high-quality reproduction. It is generally known that a steady segment of speech is such that the pitch period varies slowly. The quality of reconstructed speech will suffer almost no deterioration in the steady segment even if pitch lag of the present frame is regarded as being the same as pitch lag in a past (e.g., the immediately preceding) frame.

According to the present invention, therefore, there are provided an encoding mode 1 that uses pitch lag obtained from an input signal of a present frame and an encoding mode 2 that uses pitch lag obtained from an input signal of a past frame, a first algebraic codebook having a small number of pulses is used in the encoding mode 1 and a second algebraic codebook having a large number of pulses is used in the encoding mode 2. When encoding is performed, an encoder carries out encoding frame by frame in each of the encoding modes 1 and 2 and sends a decoder a code obtained by encoding an input signal in whichever mode enables more accurate reconstruction of the input signal. If this arrangement is adopted, the bit rate can be reduced and it becomes possible to reconstruct high-quality speech.

Further, there are provided an encoding mode 1 that uses pitch lag obtained from an input signal of a present frame and an encoding mode 2 that uses pitch lag obtained from an input signal of a past frame, a first algebraic codebook having a small number of pulses is used in the encoding mode 1 and a second algebraic codebook in which the number of pulses is greater than that of the first algebraic codebook is used in the encoding mode 2. When encoding is performed, the optimum mode is decided based upon a property of the input signal, e.g., the periodicity of the input signal, and encoding is carried out on the basis of the mode decided. If this arrangement is adopted, the bit rate can be reduced and it becomes possible to reconstruct high-quality speech.

BRIEF DESCRIPTION OF THE DRAWINGS

FIG. 2 shows an example of placement of pulses in an algebraic codebook 0;

FIG. 3 shows an example of placement of pulses in an algebraic codebook 1;

FIG. 5 shows an example of placement of pulses in an algebraic codebook 2;

FIGS. 10B and 10C show examples of placement of pulses in each algebraic codebook used in the third embodiment;

FIG. 18 shows an example of pulse placement of an algebraic codebook;

FIG. 20 shows an example of a case where four pulses reside in a 10-ms frame; and FIG. 21 shows an example of a case where three pulses reside in a 10-ms frame.

DESCRIPTION OF THE PREFERRED EMBODIMENTS (A) Overview of the Present Invention (a) First Characterizing Feature The present invention provides a first encoding mode (mode 0), which uses pitch lag obtained from an input signal of a present frame, as pitch lag of a present frame and uses an algebraic codebook of a small number of pulses and a second encoding mode (mode 1) that uses pitch lag obtained from an input signal of a past frame, e.g., the immediately preceding frame, and uses an algebraic codebook, the number of pulses of which is greater than that of the algebraic codebook used in mode 0. The mode in which encoding is performed is decided depending upon which mode makes it possible to reconstruct speech faithfully. Since the number of pulses can be increased in mode 1, the noise component of a voice signal can be expressed more faithfully as compared with mode 0.

Figure 1:
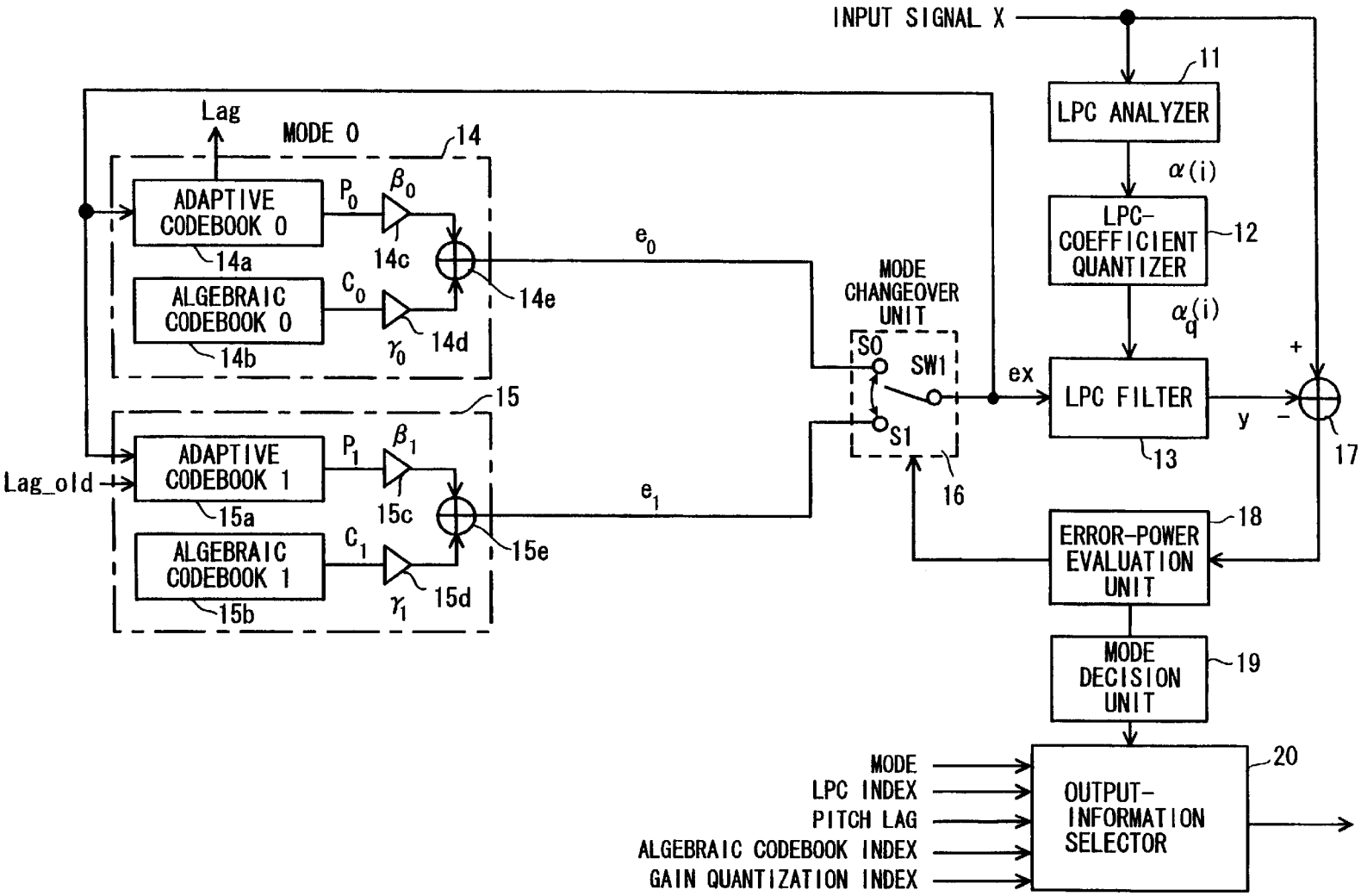
FIG. 1 is a diagram useful in describing a first overview of the present invention.

FIG. 1 is a diagram useful in describing a first overview of the present invention. An input signal vector x is input to an LPC analyzer 11 to obtain LPC coefficients $\alpha(i)$ (n=1, . . . , p), where p represents the order of LPC analysis. Here the number of dimensions of x is assumed to be the same as the number N of samples constituting a frame. Hereinafter the number of dimensions of a vector is assumed to be N unless specified otherwise. The LPC coefficients $\alpha(i)$ are quantized in an LPC-coefficients quantizer 12 to obtain quantized-LPC coefficients $\alpha_q(i)$ (n=1, . . . , p). An LPC synthesis filter 13 representing the speech characteristics of the human vocal tract in constituted by $\alpha(i)$ and the transfer function thereof is represented by the following equation:

$$H(z) = \frac{1}{1 + \sum_{i=1}^{p} \alpha_q(i) z^{-i}} \tag{19}$$

A first encoder 14 that operates in mode 0 has an adaptive codebook (adaptive codebook 0) 14*a*, an algebraic codebook (algebraic codebook 0) 14*b*, gain multipliers 14*c*, 14*d* and an adder 14*e*. A second encoder 15 that operates in mode 1 has an adaptive codebook (adaptive codebook 1) 15*a*, an algebraic codebook (algebraic codebook 1) 15*b*, gain multipliers 15*c*, 15*d* and an adder 15*e*.

Figure 17:
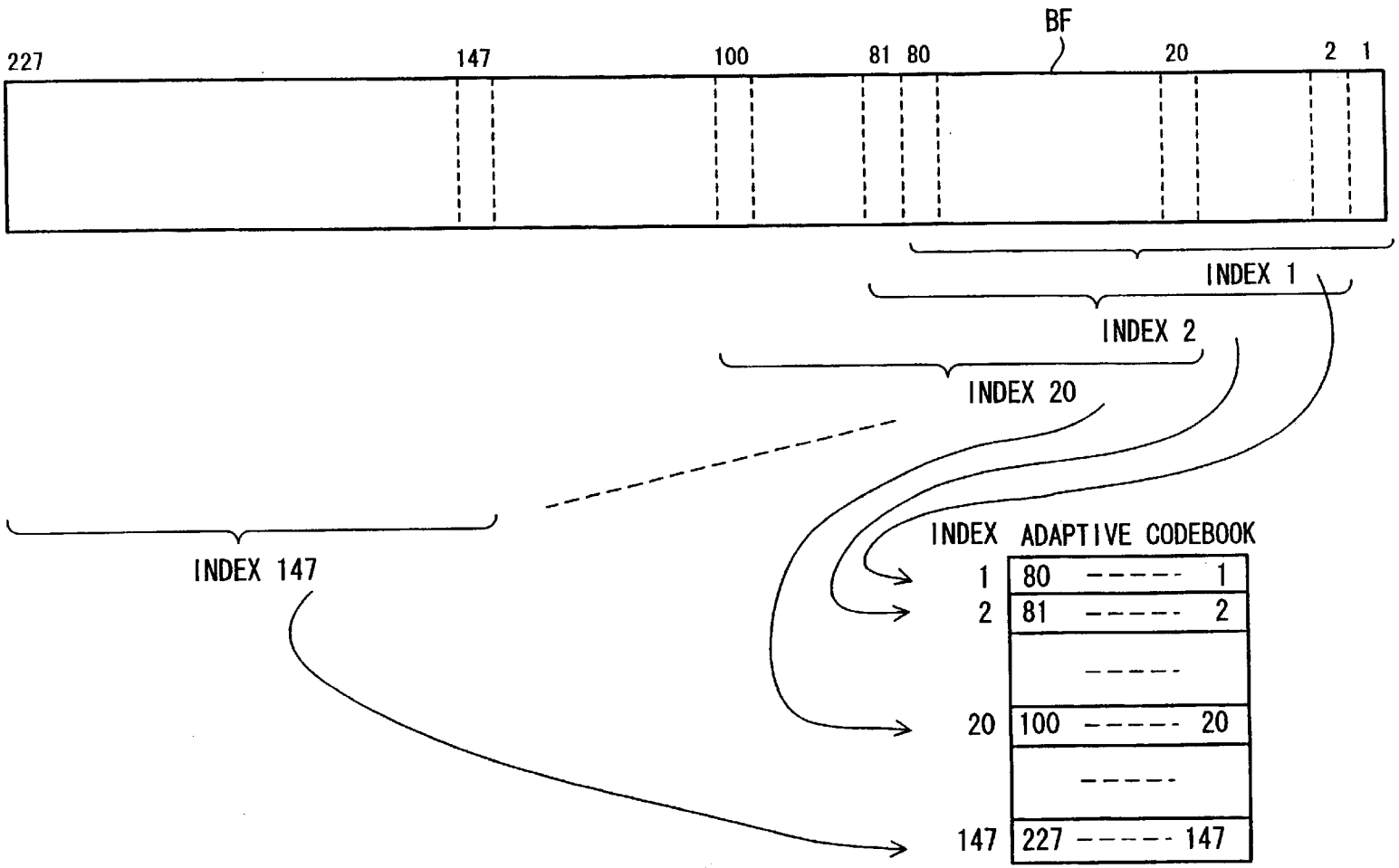
FIG. 17 PRIOR ART
FIG. 17 is a diagram useful in describing an adaptive codebook.
Figure 19:
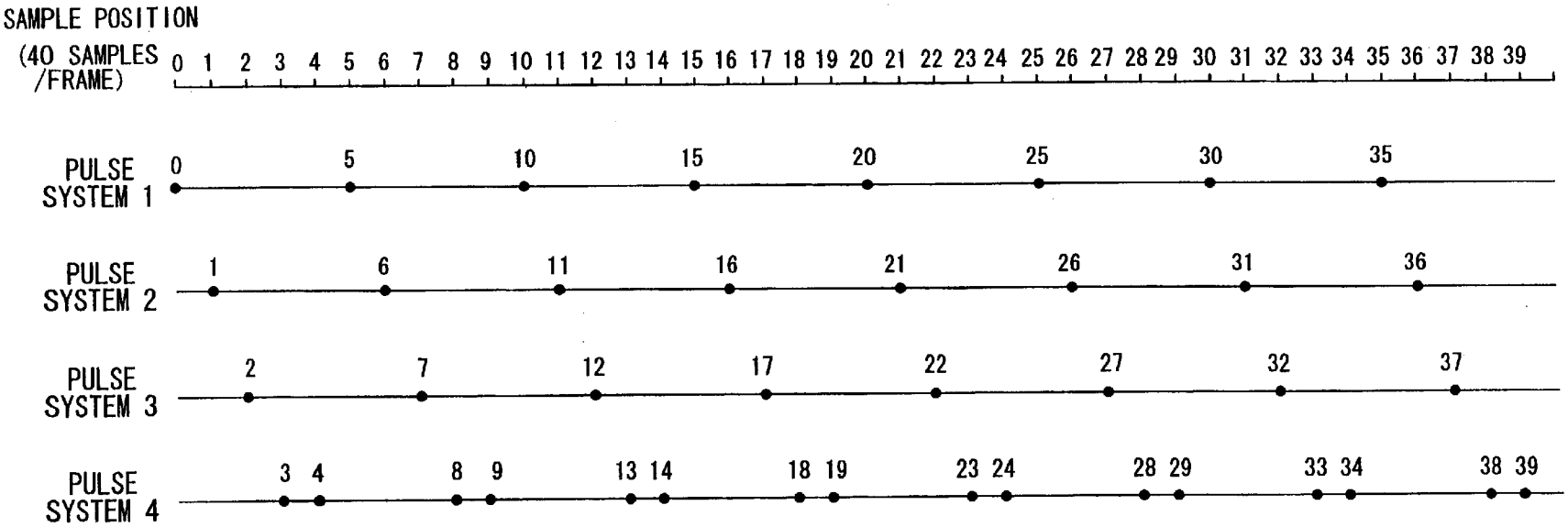
FIG. 19 PRIOR ART
FIG. 19 is a diagram useful in describing sampling points assigned to each pulse-system group.

The adaptive codebooks 14*a*, 15*a* are implemented by buffers that store the pitch-period components of the latest n samples in the past, as described in conjunction with FIG. 17. The adaptive codebooks 14*a*, 15*a* are identical in content. If N=80 samples, n=227 hold, a sound-source signal (periodicity signal) comprising 1 to 80 samples is specified by pitch lag=1, a periodicity signal comprising 2 to 81 samples is specified by pitch lag=2, . . . , and a periodicity signal comprising 147 to 227 samples is specified by a pitch lag=147.

The placement of pulses of the algebraic codebook 14*b* in the first encoder 14 is as shown in FIG. 2. The algebraic codebook 14*b* divides the N (=80) sampling points constituting one frame into three pulse-system groups 0 to 2 and, for all combinations obtained by extracting one sampling point from each of the pulse-system groups, successively outputs, as noise components, pulsed signals having a pulse of a positive polarity or negative polarity at each extracted sampling point. Five bits are required to express the pulse positions and pulse polarities in each of the pulse-system groups 0, 1, and six bits are required to express the pulse positions and pulse polarities in the pulse-system group 2. Accordingly, a total of 17 bits are necessary to specify pulsed signals and the number m of combinations thereof is 217 (m=217).

The placement of pulses of the algebraic codebook 15*b* in the second encoder 15 is as shown in FIG. 3. The algebraic codebook 15*b* divides the N (=80) sampling points constituting one frame into five pulse-system groups 0 to 4 and, for all combinations obtained by extracting one sampling point from each of the pulse-system groups, successively outputs, as noise components, pulsed signals having a pulse of a positive polarity or negative polarity at each extracted sampling point. Five bits are required to express the pulse positions and pulse polarities in all of the pulse-system groups 0 to 4. A total of 25 bits are necessary to specify pulsed signals and the number m of combinations thereof is $2^{25}$ ($m=2^{25}$).

The first encoder 14 has the same structure as that used in ordinary CELP, and the codebook search also is performed in the same manner as CELP. Specifically, pitch lag L is varied over a predetermined range (e.g., 20 to 147) in the first adaptive codebook 14*a*, adaptive codebook output $P_0(L)$ at each pitch lag is input to the LPC filter 13 via a mode changeover unit 16, an arithmetic unit 17 calculates error power between the LPC synthesis filter output signal and the input signal x, and an error-power evaluation unit 18 finds an optimum pitch lag Lag and an optimum pitch gain $\beta_0$ for which error power is minimized. Next, a signal obtained by combining a signal, which is the result of multiplying by gain $\beta_0$ the adaptive codebook output indicated by the pitch lag Lag, and pulsed signal $C_0(i)$ (i=0, . . . , m−1) output from the algebraic codebook 14*b*, is input to the LPC filter 13 via the mode changeover unit 16, the arithmetic unit 17 calculates the error power between the LPC synthesis filter output signal and the input signal x, and the error-power evaluation unit 18 decides an index $I_0$ and optimum algebraic codebook gain $\gamma_0$ that specify a pulsed signal for which the error power is smallest. Here $m=2^{17}$ represents the size of the algebraic codebook 14*b* (the total number of combinations of pulses).

If the optimum codebook search and algebraic codebook search by the first encoder 14 are completed, the second encoder 15 starts the processing of mode 1. Mode 1 differs from mode 0 in that the adaptive codebook search is not conducted. It is generally known that a steady segment of speech is such that the pitch period varies slowly. The quality of reconstructed speech will suffer almost no deterioration in the steady segment even if pitch lag of the present frame is regarded as being the same as pitch lag in a past (e.g., the immediately preceding) frame. In such case it is unnecessary to send pitch lag to a decoder and hence leeway equivalent to the number of bits (e.g., eight) necessary to encode pitch lag is produced. Accordingly, these eight bits are used to express the index of the algebraic codebook. If this expedient is adopted, the placement of pulses in the algebraic codebook 15*b* can be made as shown in FIG. 3 and the number of pulses of the pulse signal can be increased. When the number of transmitted bits of an algebraic codebook (or noise codebook, etc.) is enlarged in CELP, a more complicated sound-source signal can be expressed and the quality of reconstructed speech is improved.

Thus, the second encoder 15 does not conduct an adaptive codebook search, regards optimum pitch lag lag_old, which was obtained in a past frame (e.g., the preceding frame), as optimum lag of the present frame and finds the optimum pitch gain $\beta_1$ prevailing at this time. Next, the second encoder 15 conducts an algebraic codebook search using the algebraic codebook 15*b* in a manner similar to that of the algebraic codebook search in the first encoder 14, and decides an optimum index $I_1$ and optimum algebraic codebook gain $\gamma_1$ specifying a pulsed signal for which the error power is smallest.

If the search processing in the first and second encoders 14, 15 is completed, the sound-source signal vector of mode 0, namely $$e_0=\beta_0 \cdot P_0(Lag)+\gamma_0 \cdot C_0(I_0)$$

is found from the output vector $P_0(\text{lag})$ of the optimum adaptive codebook 14*a* decided in mode 0 and the output vector $C_0(\mathbf{I0})$ of the algebraic codebook 14*b* in mode 0. Similarly, the sound-source signal vector of mode 1, namely $$e_1=\beta_1 \cdot P_1(Lag_old)+\gamma_1 \cdot C_1(I_1)$$

is found from the output vector $P_0(\text{lag_old})$ of the adaptive codebook decided in mode 1 and the output vector $C_1(I_1)$ of the algebraic codebook 15*b* in mode 1. The error-power evaluation unit 18 calculates each error power between the sound-source vectors $e_0$, $e_1$ and input signal. A mode decision unit 19 compares the error power values that enter from the error-power evaluation unit 18 and decides the mode which will finally be used is that which provides the smaller error power. An output-information selector 20 selects, and transmits to the decoder, mode information, LPC quantization index, pitch lag and the algebraic codebook index and gain quantization index of the mode used.

At the end of all search processing and quantization processing of the present frame, the state of the adaptive codebook is updated before the input signal of the next frame is processed. In state updating, a frame length of the sound-source signal of the oldest frame (the frame farthest in the past) in the adaptive codebook is discarded and the latest sound-source signal $e_x$ (sound-source signal $e_0$ or $e_1$) found in the present frame is stored. It should be noted that the initial state of the adaptive codebook is assumed to be the zero state.

In the description rendered above, the mode finally used is decided after the adaptive codebook search/algebraic codebook search are conducted in all modes (modes 0, 1). However, it is possible to adopt an arrangement in which, prior to a search, the properties of the input signal are investigated, which mode is to be adopted is decided in accordance with these properties, and encoding is executed by conducting the adaptive codebook search/algebraic codebook search in whichever mode has been adopted. Further, the above description is rendered using two adaptive codebooks. However, since exactly the same past sound-source signals will have been stored in the two adaptive codebooks, implementation is permissible using one of the adaptive codebooks.

(b) Second Characterizing Feature

Figure 4:
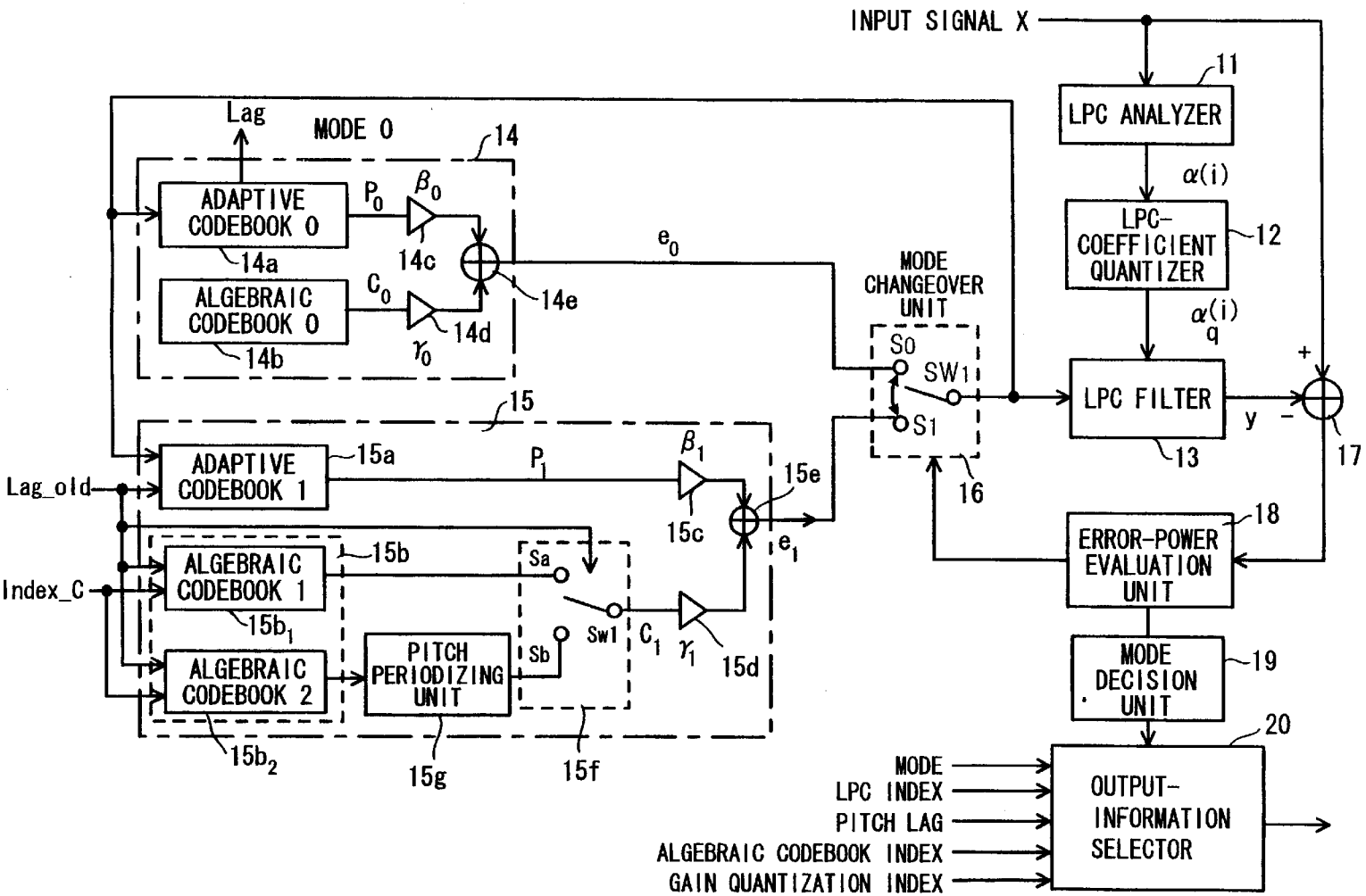
FIG. 4 is a diagram useful in describing a second overview of the present invention.

FIG. 4 is a diagram useful in describing a second overview of the present invention, in which components identical with those shown in FIG. 1 are designated by like reference characters. This arrangement differs in the construction of the second encoder 15.

Provided as the algebraic codebook 15*b* of the second encoder 15 are (1) a first algebraic codebook 15$b_1$ and (2) a second algebraic codebook 15$b_2$ in which the number of pulses is greater than that of the first algebraic codebook 15$b_1$. The first algebraic codebook 15$b_1$ has the pulse placement shown in FIG. 3. The first algebraic codebook 15$b_1$ divides the N (=80) sampling points constituting one frame into a plurality (=5) of pulse-system groups and successively outputs pulsed signals having a pulse of a positive polarity or negative polarity at sampling points extracted one at a time from each of the pulse-system groups. On the other hand, as shown in FIG. 5, the second algebraic codebook 15$b_2$ divides M (=55) sampling points, which are contained in a period of time shorter than the duration of one frame, into a number (=6) of pulse-system groups greater than that of the first algebraic codebook 15$b_1$, and successively outputs pulsed signals having a pulse of a positive polarity or negative polarity at sampling points extracted one at a time from each of the pulse-system groups.

In mode 1, in which the value of pitch lag Lag_old found from the input signal of a past frame (e.g., the preceding frame) is used as the pitch lag of the present frame, an algebraic codebook changeover unit 15*f* selects the pulsed signal output of the first algebraic codebook 15$b_1$ if the value of Lag_old in the past is greater than M, and selects the pulsed signal output of the second algebraic codebook 15$b_2$ if the value of Lag_old is less than M.

Since the second algebraic codebook 15$b_2$ places the pulses over a range narrower than that of the first algebraic codebook 15$b_1$, a pitch periodizing unit 15*g* executes pitch periodization processing for repeatedly outputting the pulsed signal pattern of the second algebraic codebook 15$b_2$.

Thus, in accordance with the present invention, as set forth above, there is provided, in addition to (1) the conventional CELP mode (mode 0), (2) a mode (mode 1) in which the amount of information for transmitting pitch lag is reduced by using past pitch lag and the amount of information of an algebraic codebook is increased correspondingly, thereby making it possible to obtain high-quality reconstructed voice in a steady segment of speech, such as a voiced segment. Further, by switching between mode 0 and mode 1 in dependence upon the properties of the input signal, it is possible to obtain high-quality reconstructed voice even with regard to input voice of various properties.

(B) First Embodiment of Voice Encoding Apparatus

Figure 6:
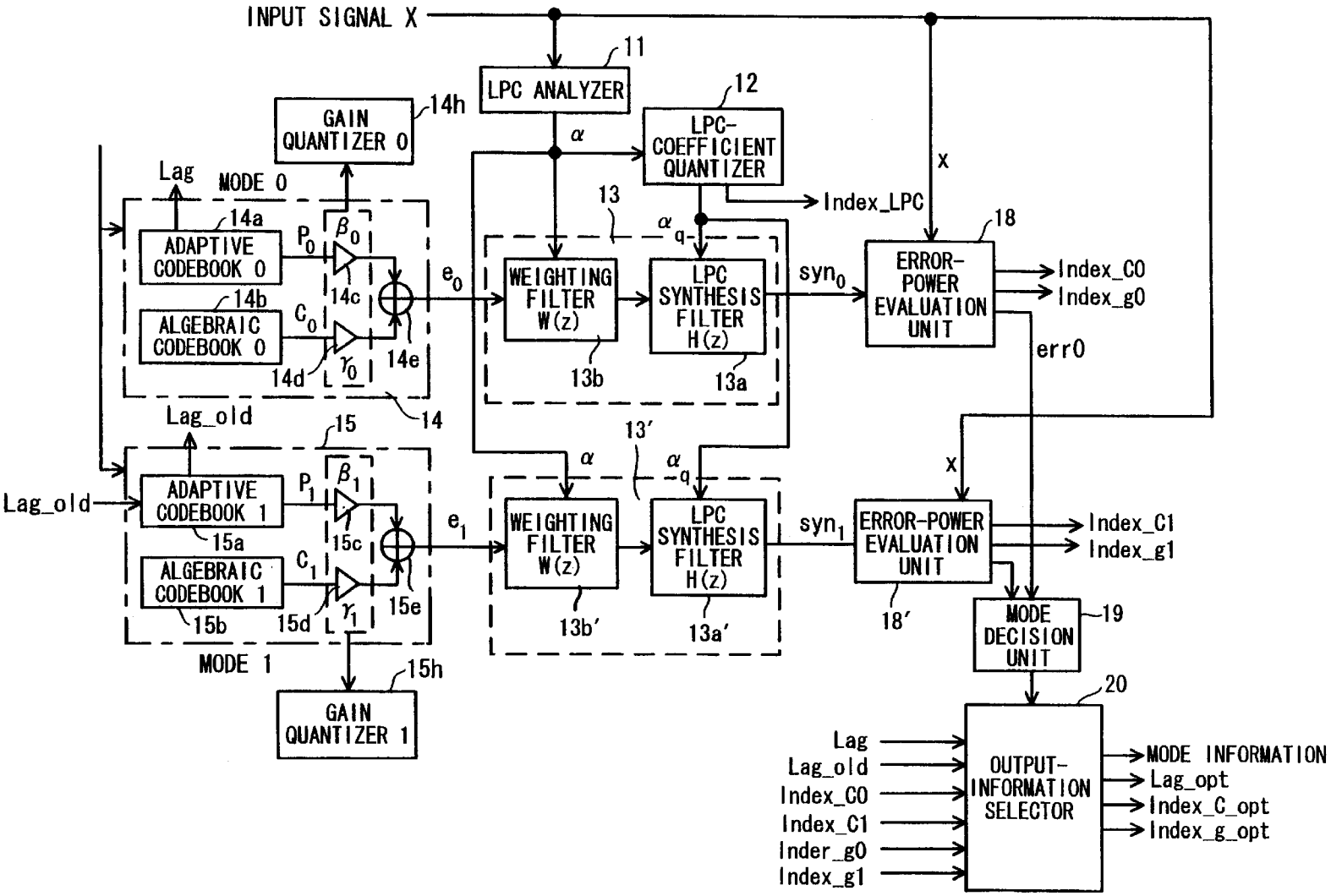
FIG. 6 is a block diagram of a first embodiment of an encoding apparatus.

FIG. 6 is a block diagram of a first embodiment of a voice encoding apparatus according to the present invention. This apparatus has the structure of a voice encoder comprising two modes, namely mode 0 and mode 1.

The LPC analyzer 11 and LPC-coefficient quantizer 12, which are common to mode 0 and mode 1, will be described first. The input signal is divided into fixed-length frames on the order of 5 to 10 ms, and encoding processing is executed in frame units. It is assumed here that the number of samplings in one frame is N. The LPC analyzer (linear prediction analyzer) 11 obtains the LPC coefficients $\alpha=\{\alpha(1), \alpha(2), \ldots, \alpha(p)\}$ from the input signal x of N samples in one frame.

Next, the LPC-coefficient quantizer 12 quantizes the LPC coefficients $\alpha$ and obtains an LPC quantization index Index_LPC and an inverse quantization value (quantized LPC coefficients) $\alpha_q=\{\alpha_q1(1), \alpha_q(2), \ldots, \alpha_q(p)\}$ of the LPC coefficients. The gain quantization method is optional and a method such as scalar quantization or vector quantization can be used. Further, the LPC coefficients, rather than being quantized directly, may be quantized after first being converted to another parameter of superior quantization characteristic and interpolation characteristic, such as a k parameter (reflection coefficient) or LSP (line-spectrum pair). The transfer function H(z) of an LPC synthesis filter 13*a* constructing the auditory weighting LPC filter 13 is given by the following equation:

$$H(z) = \frac{1}{1 + \sum_{i=1}^{p} \alpha_q(i) z^{-i}} \tag{20}$$

It is possible for a filter of any type to be used as an auditory weighting filter 13*b*. A filter indicated by Equation (3) can be used.

The first encoder 14, which operates in accordance with mode 0, has the same structure as that used in ordinary CELP, includes the adaptive codebook 14*a*, algebraic codebook 14*b*, gain multipliers 14*c*, 14*d*, an adder 14*e* and a gain quantizer 14*h*, and obtains (1) optimum pitch lag Lag, (2) an algebraic codebook index index_C1 and (3) a gain index index_g1. The search method of the adaptive codebook 14*a* and the search method of the algebraic codebook 14*b* in mode 0 are the same as the methods described in the section (A) above relating to an overview of the present invention.

In a case where the frame length is 10 ms (80 samples), the algebraic codebook 14*b* has a pulse placement of three pulses, as shown in FIG. 2. Accordingly, the output $C_0(n)$ (n=0, . . . , N−1) of the algebraic codebook 14*b* is given by the following equation:

$$C_0(n)=s_0\delta(n-m_0)+s_1\delta(n-m_1)+s_2\delta(n-m_2) \tag{21}$$

where $s_i$ represents the polarity (+1 or −1) of a pulse system i, $m_i$ represents the pulse position of the pulse system i, and $\delta(\mathbf{0})=1$ holds. The first term on the right side of Equation (21) signifies placement of pulse $s_0$ at pulse position $m_0$ in pulse-system group 0, the second term on the right side signifies placement of pulse $s_1$ at pulse position $m_1$ in pulse-system group 1, and the third term on the right side signifies placement of pulse $s_2$ at pulse position $m_2$ in pulse-system group 2. When the algebraic codebook search is conducted, the pulsed output signal of Equation (21) is output successively and a search is conducted for the optimum pulsed signal.

The gain quantizer 14*h* quantizes pitch gain an algebraic codebook gain. The quantization method is optional and a method such as scalar quantization or vector quantization can be used. If we let $P_0$ represent the output of the first adaptive codebook 14*a* decided in mode 0, $C_0$ the output of the algebraic codebook 14*b*, $\beta_0$ the quantized pitch gain and $\gamma_0$ the quantized gain of the algebraic codebook 14*b*, respectively, then the optimum sound-source vector $e_0$ of mode 0 will be given by the following equation:

$$e_0=\beta P_0 P_0+\gamma_0 C_0 \tag{22}$$

The sound-source vector $e_0$ is input to the weighting filter 13*b* and the output thereof is input to the LPC synthesis filter 13*a*, whereby a weighted synthesized output $syn_0$ is created. The error-power evaluation unit 18 of mode 0 calculates error power err0 between the input signal x and output $syn_0$ of the LPC synthesis filter and inputs the error power to the mode decision unit 19.

The adaptive codebook 15*a* does not execute search processing, regards optimum pitch lag lag_old, which was obtained in a past frame (e.g., the preceding frame), as optimum lag of the present frame and finds the optimum pitch gain $\beta_1$. The optimum pitch gain can be calculated in accordance with Equation (6). As mentioned earlier, it is unnecessary in mode 1 to transmit pitch lag to the decoder and, hence, the number of bits (e.g., eight bits per frame) required to transmit pitch lag can be allocated to quantization of the algebraic codebook index. As a result, though the algebraic codebook index must be expressed by 17 bits in mode 0, the algebraic codebook index can be expressed by 25 (=17+8) in mode 1. Accordingly, in a case where the length of one frame is 10 ms (80 samples), the number of pulses can be made 5 in the pulse placement of the algebraic codebook 15*b*, as shown in FIG. 3. The output $C_1(n)$ (n=0, . . . , N−1) of the algebraic codebook 15*b*, therefore, is represented by the following equation:

$$C_1(n)=\sum_{i=0}^{4} s_i \delta(n-m_i) \tag{23}$$

When a search of the algebraic codebook 15*b* is conducted, the algebraic codebook index Index_C1 and gain index Index_g1 are obtained by successively outputting $C_1(n)$ expressed by Equation (23). The method of searching the algebraic codebook 15*b* is the same as the method described in the section (A) above relating to an overview of the present invention.

If we let $P_1$ represent the output of the adaptive codebook 15*a* decided in mode 1, $C_1$ the output of the algebraic codebook 15*b*, $\beta_1$ the quantized pitch gain and $\gamma_1$, the quantized gain of the algebraic codebook 15*b*, respectively, then the optimum sound-source vector $e_1$ of mode 1 will be given by the following equation:

$$e_1=\beta_1 P_1+\gamma_1 C_1 \tag{24}$$

The sound-source vector $e_1$ is input to a weighting filter 13*b*' and the output thereof is input to an LPC synthesis filter 13*a*', whereby a weighted synthesized output $syn_1$ is created. An error-power evaluation unit 18' calculates error power err1 between the input signal x and the weighted synthesized output $syn_1$ and inputs the error power to the mode decision unit 19.

The mode decision unit 19 compares err0 and err1 and decides that the mode which will finally be used is that which provides the smaller error power. The output-information selector 20 makes the mode information 0 if err0<err1 holds, makes the mode information 1 if err0>err1 holds, and selects a predetermined mode (0 or 1) if err0=err1 holds. Further, the output-information selector 20 selects pitch lag Lag_opt, the algebraic codebook index Index_C and the gain index Index_g on the basis of the mode used, adds the mode information and LPC index information onto these to create the final encoded data (transmit information), and transmits this information.

At the end of all search processing and quantization processing of the present frame, the state of the adaptive codebook is updated before the input signal of the next frame is processed. In state updating, the oldest frame (the frame farthest in the past) of the sound-source signal in the adaptive codebook is discarded and the latest sound-source signal $e_x$ (the above-mentioned $e_0$ or $e_1$) found in the present frame is stored. It should be noted that the initial state of the adaptive codebook is assumed to be the zero state, i.e., a state in which the amplitudes of all samples are zero.

In the embodiment of FIG. 6, use of the two adaptive codebooks 14*a*, 15*a* is described. However, since exactly the same past sound-source signals are stored in the two adaptive codebooks, implementation is permissible using one of the adaptive codebooks. Further, in the embodiment of FIG. 6, two weighting filters, two LPC synthesis filters and two error-power evaluation units are used. However, these pairs of devices can be united into single common devices.

Thus, in accordance with the first embodiment, there are provided (1) the conventional CELP mode (mode 0) and (2) a mode (mode 1) in which the pitch-lag information is reduced by using past pitch lag and the amount of information of an algebraic codebook is increased by the amount of reduction. As a result, in unsteady segments, such as unvoiced or transient segments, encoding processing the same as that of conventional CELP can be executed. In steady segments of speech such as voiced segments, on the other hand, the sound-source signal can be encoded precisely by mode 1, thereby making it possible to obtain high-quality reconstructed voice.

(C) Second Embodiment of Voice Encoding Apparatus

Figure 7:
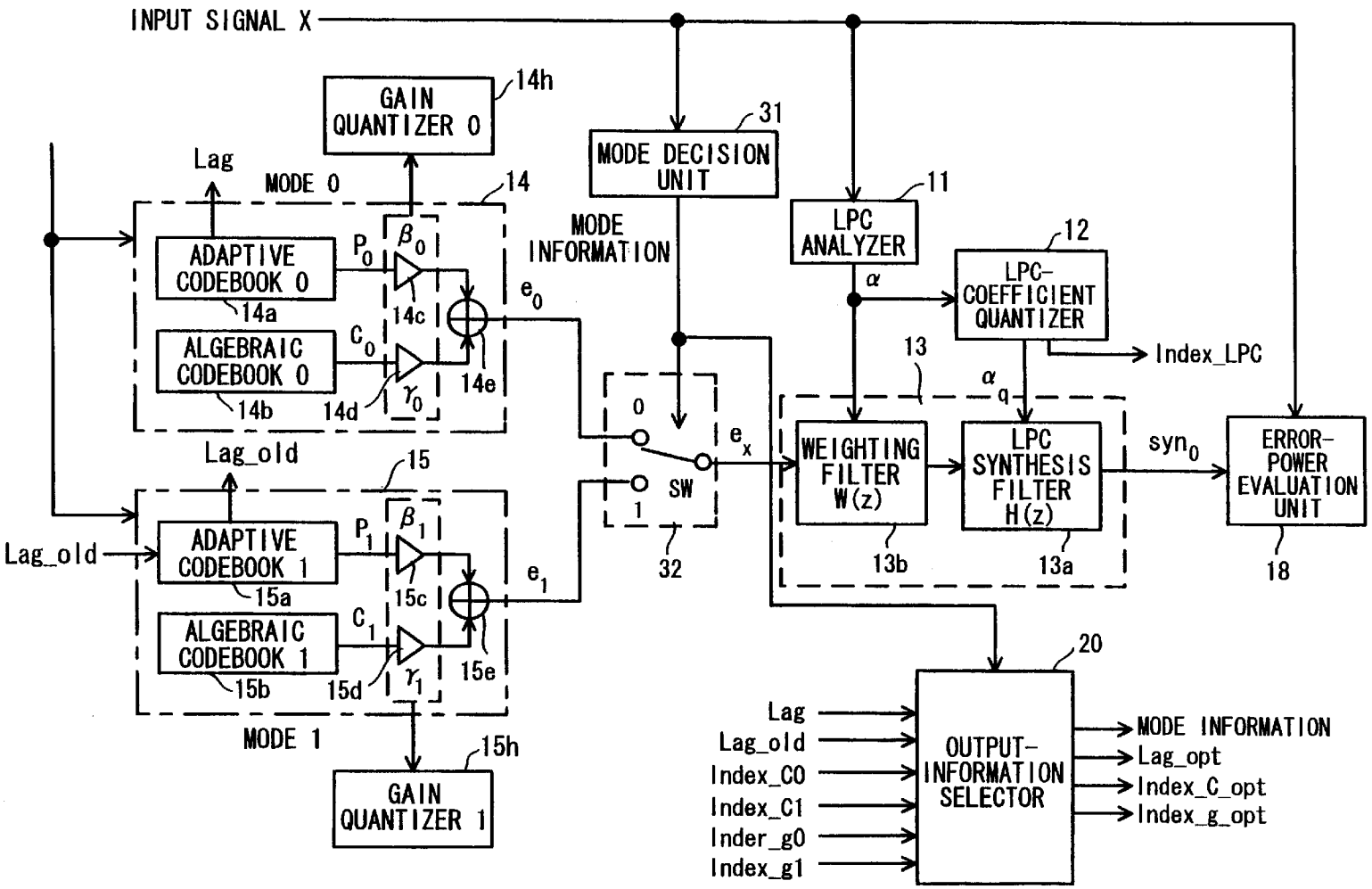
FIG. 7 is a block diagram of a second embodiment of an encoding apparatus.

FIG. 7 is a block diagram of a second embodiment of a voice encoding apparatus, in which components identical with those of the first embodiment shown in FIG. 6 are designated by like reference characters. In the first embodiment, an adaptive codebook search and an algebraic codebook search are executed in each mode, the mode that affords the smaller error is decided upon as the mode finally used, the pitch lag Lag_opt, algebraic codebook index Index_C and the gain index Index_g found in this mode are selected and these are transmitted to the decoder. In the second embodiment, however, the properties of the input signal are investigated before the search, which mode is to be adopted is decided in accordance with these properties, and encoding is executed by conducting the adaptive codebook search/algebraic codebook search in whichever mode has been adopted. The second embodiment differs from the first embodiment in that:

(1) a mode decision unit 31 is provided to investigate the properties of the input x before a codebook search and decide which mode to adopt in accordance with the properties of the signal;

(2) a mode-output selector 32 is provided to select the outputs of the encoders 14, 15 conforming to the adopted mode and input the selected output to the weighting filter 13*b;*

(3) the weighting filter [W(z)] 13*b*, LPC synthesis filter [H(z)] 13*a* and error-power evaluation unit 18 are provided in a form shared by each mode; and (4) the output-information selector 20 selects and transmits information, which is sent to the decoder, based upon mode information that enters from the mode decision unit 31.

Figure 8:
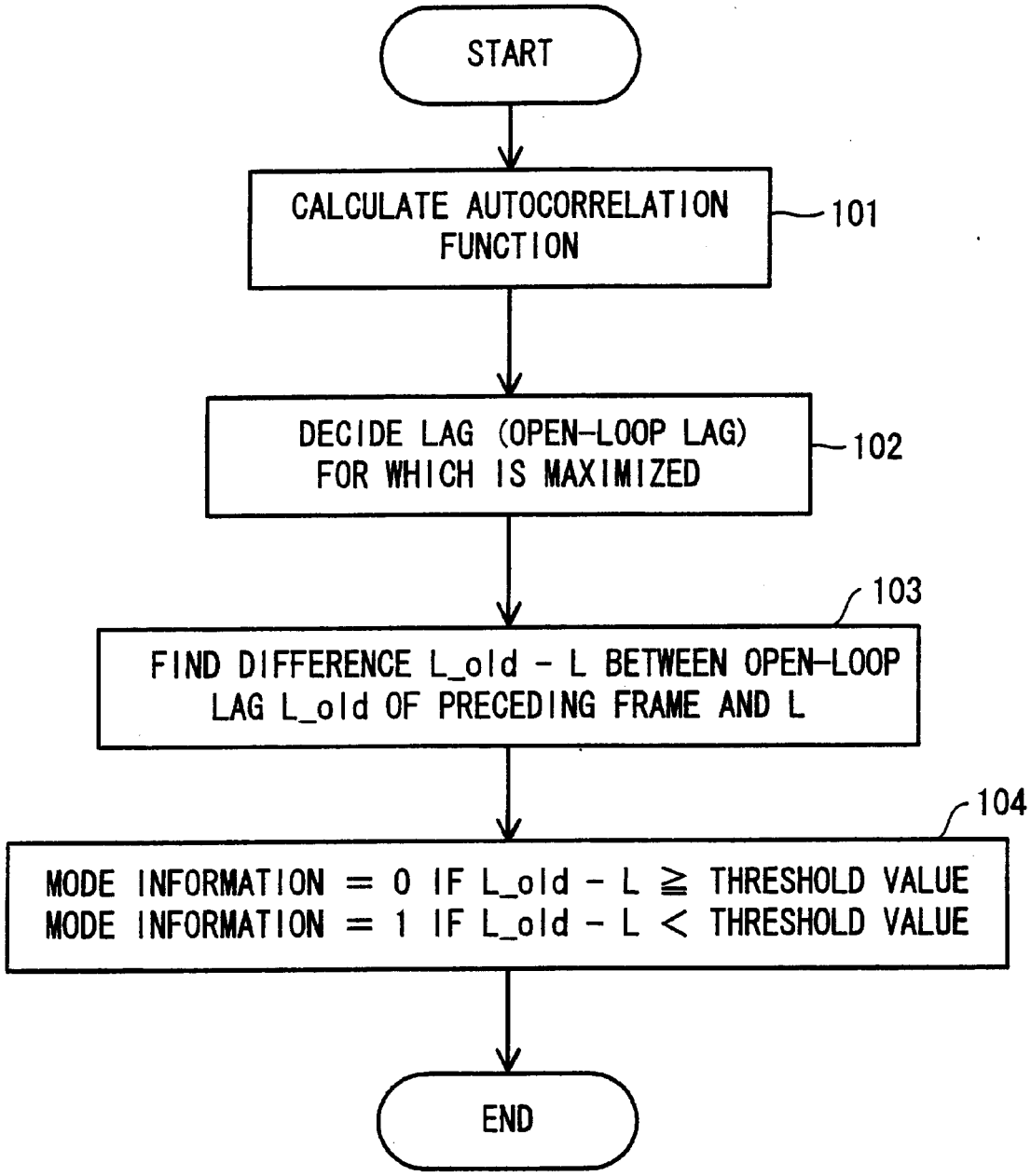
FIG. 8 shows the processing procedure of a mode decision unit.

When the input signal vector x is input thereto, the mode decision unit 31 investigates the properties of the input signal x and generates mode information indicating which of the modes 0, 1 should be adopted in accordance with these properties. The mode information becomes 0 if mode 0 is determined to be optimum and becomes mode 1 if mode 1 is determined to be optimum. On the basis of the results of the decision, the mode-output selector 32 selects the output of the first encoder 14 or the output of the second encoder 15. A method of detecting a change in open-loop lag can be used as the method of rendering the mode decision. FIG. 8 shows the processing flow for deciding the mode adopted based upon the properties of the input signal. First, an autocorrelation function R(k) (k=20 to 143) is obtained (step 101) by the following equation using an input signal x(n) (n=0, . . . , N−1):

$$R(k) = \sum_{n=0}^{N-1} x(n)x(n-k) \tag{25}$$

where N represents the number of samples constituting one frame.

Next, the k for which the autocorrelation function R(k) is maximized is found (step 102). Lag k that prevails when the autocorrelation function R(k) is maximized is referred to as "open-loop lag" and is represented by L. Open-loop lag found similarly in the preceding frame shall be denoted L_old. This is followed by finding the difference (L_old-L) between open-loop lag L old of the preceding frame and open-loop lag L of the present frame (step 103). If (L_old-L) is greater than a predetermined threshold value, then it is construed that the periodicity of input voice has undergone a large change and, hence, the mode information is set to 0. On the other hand, if (L_old-L) is less than the predetermined threshold value, then it is construed that the periodicity of input voice has not changed as compared with the preceding frame and, hence, the mode information is set to 1 (step 104). The above-described processing is thenceforth repeated frame by frame. Furthermore, following the end of mode decision, the open-loop lag L found in the present frame is retained as L_old in order to render the mode decision for the next frame.

The mode-output selector 32 selects a terminal 0 if the mode information is 0 and selects a terminal 1 if the mode information is 1. Accordingly, the two modes do not function simultaneously in the same frame.

If mode 0 is set by the mode decision unit 31, the first encoder 14 conducts a search of the adaptive codebook 14*a* and of algebraic codebook 14*b*, after which quantization of pitch gain $\beta_0$ and algebraic codebook gain $\gamma_0$ is executed by the gain quantizer 14*h*. The second encoder conforming to mode 1 does not operate at this time.

If mode 1 is set by the mode decision unit 31, on the other hand, the second encoder 15 does not conduct an adaptive codebook search, regards optimum pitch lag lag_old found in a past frame (e.g., the preceding frame) as the optimum lag of the present frame and obtains the optimum pitch gain $\beta_1$ that prevails at this time. Next, the second encoder 15 conducts an algebraic codebook search using the algebraic codebook 15*b* and decides the optimum index $I_1$ and optimum gain $\gamma_1$ that specify the pulsed signal for which error power is minimized. A gain quantizer 15*h* then executes quantization of the pitch gain $\beta_1$ and algebraic codebook gain $\gamma_1$. The first encoder 14 on the side of mode 0 does not operate at this time.

In accordance with the second embodiment, in which mode encoding is to be performed is decided based upon the properties of the input signal before a codebook search, encoding is performed in this mode and the result is output. As a result, it is unnecessary to perform encoding in two modes and then select the better result, as is done in the first embodiment. This makes it possible to reduce the amount of processing and enables high-speed processing.

(D) Third Embodiment of Voice Encoding Apparatus

Figure 9:
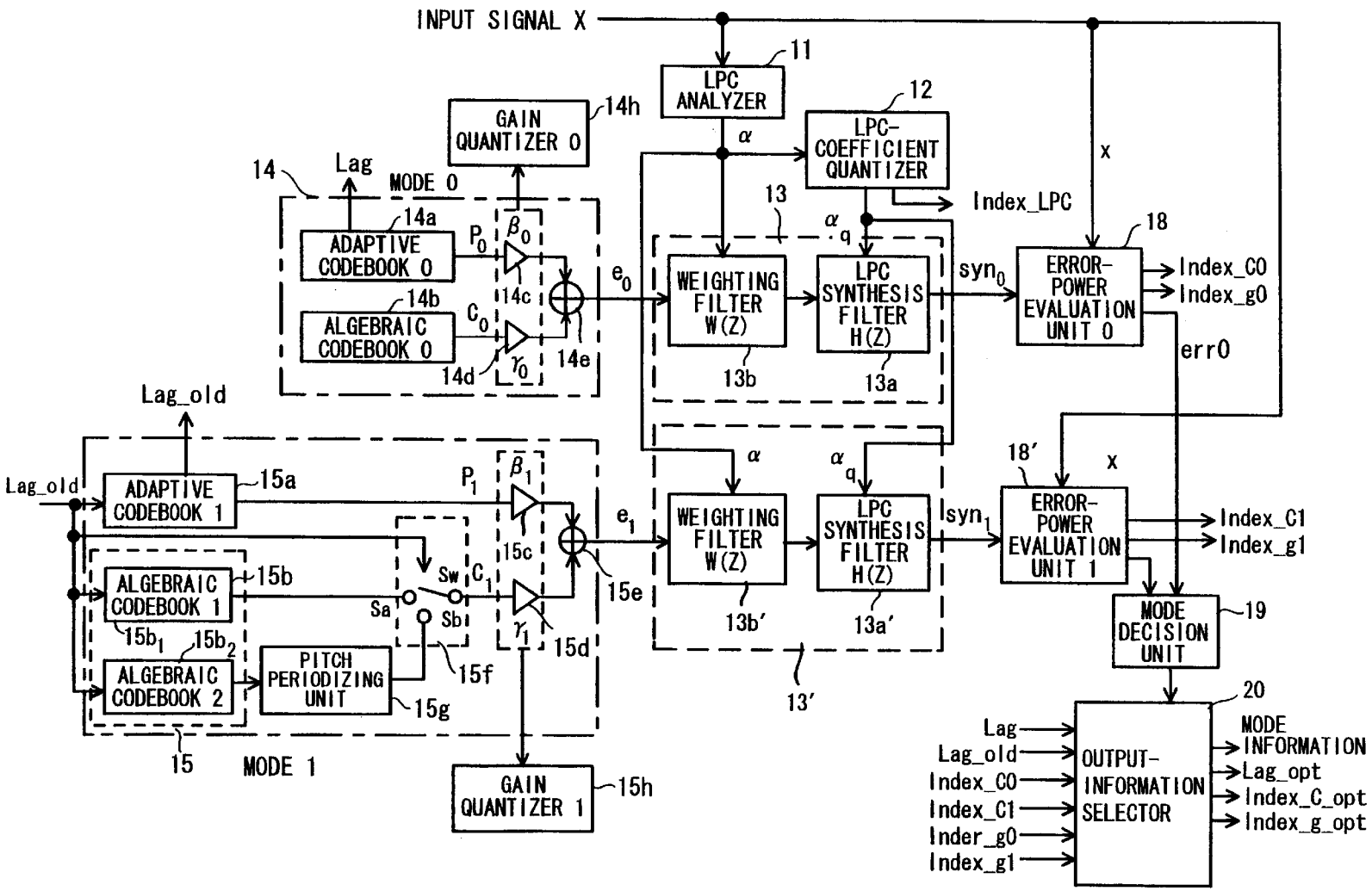
FIG. 9 is a block diagram of a third embodiment of an encoding apparatus.

FIG. 9 is a block diagram of a third embodiment of a voice encoding apparatus, in which components identical with those of the first embodiment shown in FIG. 6 are designated by like reference characters. This embodiment differs from the first embodiment in that:

(1) the first algebraic codebook 15$b_1$ and second algebraic codebook 15$b_2$ are provided as the algebraic codebook 15*b* of the second encoder 15, the first algebraic codebook 15$b_1$ has a pulse placement indicated in FIG. 10B, and the second algebraic codebook 15$b_2$ has the pulse placement shown in FIG. 10C;

(2) the algebraic codebook changeover unit 15*f* is provided, selects the pulsed signal, which is the noise component output of the first algebraic codebook 15$b_1$, if the value Lag_old of pitch lag in the past in mode 1 is greater than a threshold value Th, and selects the pulsed signal output of the second algebraic codebook 15$b_2$ if the value Lag_old is less than the threshold value Th; and (3) since the second algebraic codebook 15$b_2$ places the pulses over a range (sampling points 0 to 55) narrower than that of the first algebraic codebook 15$b_1$, the pitch periodizing unit 15*g* is provided and repeatedly generates the pulsed signal, which is output from the second algebraic codebook 15$b_2$, thereby outputting one frame of the pulsed signal.

In mode 0, the first encoder 14 obtains optimum pitch lag Lag, the algebraic codebook index Index_C0 and the gain index Index_g0 by processing exactly the same as that of the first embodiment.

In mode 1, the second encoder 15 does not conduct a search of the adaptive codebook 15*a* and uses the optimum pitch lag Lag_old, which was decided in a past frame (e.g., the preceding frame), as the optimum pitch lag of the present frame in a manner similar to that of the first embodiment. The optimum pitch gain is calculated in accordance with Equation (6). Further, when the algebraic codebook search is conducted, the second encoder 15 conducts the search using the first algebraic codebook 15$b_1$ or second algebraic codebook 15$b_2$, depending upon the value of the pitch lag Lag_old.

An algebraic codebook search in modes 0 and 1 in a case where frame length is 10 ms and N=80 samples holds will now be described.

(1) Mode 0

An example of pulse placement of the algebraic codebook 14*b* used in mode 0 is illustrated in FIG. 10(*a*). This pulse placement is that for a case where the number of pulses is three and the number of quantization bits is 17. Here $C_0(n)$ (n=0, . . . , N−1) indicated by Equation (21) is successively output and an algebraic codebook search similar to that of the prior art is conducted. In Equation (21), $s_i$ represents the polarity (+1 or −1) of a pulse-system group i, $m_i$ represents the pulse position of the pulse-system group i, and $\delta(0)=1$ holds.

(2) Mode 1

In mode 1, past pitch lag Lag_old is used and therefore quantization bits are not allocated to pitch lag. As a consequence, it is possible to allocate a greater number of bits to the algebraic codebooks 15$b_1$, 15$b_2$ than to the algebraic codebook 14*b*. If the number of quantization bits of pitch lag in mode 0 is eight per frame, then it will be possible to allocate 25 bits (=17+8) as the number of quantization bits of the algebraic codebooks 15$b_1$, 15$b_2$.

An example of pulse placement in a case where five pulses reside in one frame at 25 bits is illustrated in FIG. 10B. The first algebraic codebook 15$b_1$ has this pulse placement and successively outputs pulsed signals having a pulse of a positive polarity or negative polarity at sampling points extracted one at a time from each of the pulse-system groups. Further, an example of pulse placement in a case where six pulses reside in a period of time shorter than the duration of one frame at 25 bits is as shown in FIG. 10C. The second algebraic codebook 15$b_2$ has this pulse placement and successively outputs pulsed signals having a pulse of a positive polarity or negative polarity at sampling points extracted one at a time from each of the pulse-system groups.

The pulse placement of FIG. 10B is such that the number of pulses per frame is two greater in comparison with FIG. 10A. The pulse placement of FIG. 10C is such that the pulses are placed over a narrow range (sampling points 0 to 55); there are three more pulses in comparison with FIG. 10A. In mode 1, therefore, it is possible to encode a sound-source signal more precisely than in mode 0. Further, the second algebraic codebook 15$b_2$ places pulses over a range (sampling points 0 to 55) narrower than that of the first algebraic codebook 15$b_1$ but the number of pulses is greater. Consequently, the second algebraic codebook 15$b_2$ is capable of encoding the sound-source signal more precisely than the first algebraic codebook 15$b_1$. In mode 1, therefore, if the periodicity of the input signal x is short, a pulsed signal, which is the noise component, is generated using the second algebraic codebook 15$b_2$. If the periodicity of the input signal x is long, then a pulsed signal that is the noise component is generated using the first algebraic codebook 15$b_2$.

Thus, in mode 1, if past pitch lag Lag_old is greater than a predetermined threshold value Th (e.g., 55), the output $C_1(n)$ of first algebraic codebook 15$b_1$ is found in accordance with the following equation:

$$C_1(n) = \sum_{i=0}^{4} s_i \delta(n - m_i) \tag{26}$$

and this output is delivered successively to thereby obtain the algebraic codebook index Index_C1 and gain index Index_g1.

On the other hand, if past pitch lag Lag_old is less than a predetermined threshold value Th (e.g., 55), a search is conducted using the second algebraic codebook 15$b_2$. The method of searching the second algebraic codebook 15$b_2$ may be similar to the algebraic codebook search already described, though it is required that impulse response be subjected to pitch periodization before search processing is executed. If the impulse response of the auditory weighting synthesis filter 13 is a(n) (n=0, . . . , 79), then impulse response a' (n) (n=0, . . . , 79) that has undergone pitch periodization is found by the following equation before the second algebraic codebook 15$b_2$ is searched:

$$a'(n) = \begin{cases} a(n) & (n < \text{Lag_old}) \\ a'(n - \text{Lag_old}) & (n \geq \text{Lag_old}) \end{cases} \tag{27}$$

In this case, the pitch periodization method will not be only simple repetition; repetition may be performed while decreasing or increasing Lag_old-number of the leading samples at a fixed rate.

The search of the second algebraic codebook 15$b_2$ is conducted using a' (n) mentioned above. However, since the output obtained by searching the second algebraic codebook 15$b_2$ only has pulses from samples 0 to Th (=55), the pitch periodizing unit 15*g* generates the remaining samples (24 samples in this example) by pitch periodization processing indicated by the following equation:

$$C_1(n) = \begin{cases} \sum_{i=0}^{5} s_i \delta(n - m_i) & (n < \text{Lag_old}) \\ C_1(n - \text{Lag_old}) & (n \geq \text{Lag_old}) \end{cases} \tag{28}$$

Figure 11:
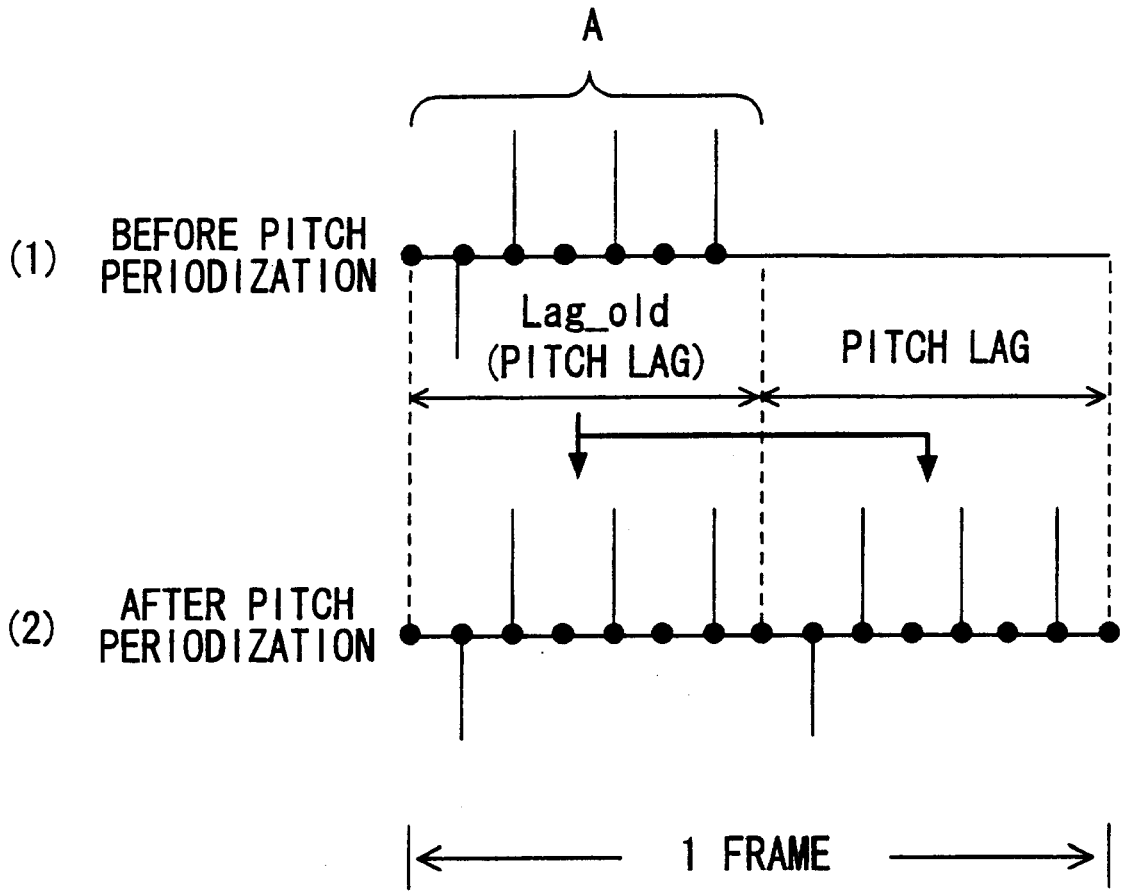
FIG. 11 is a conceptual view of pitch periodization.

FIG. 11 is a conceptual view of pitch periodization by the pitch periodizing unit 15*g*, in which (1) represents a pulsed signal, namely a noise component, prior to the pitch periodization, and (2) represents the pulsed signal after the pitch periodization. The pulsed signal after pitch periodization is obtained by repeating (copying) a noise component A of an amount commensurate with pitch lag Lag_old before pitch periodization. Further, the pitch periodization method will not be only simple repetition; repetition may be performed while decreasing or increasing Lag_old-number of the leading samples at a fixed rate.

(c) Algebraic Codebook Changeover

The algebraic codebook changeover unit 15*f* connects a switch Sw to a terminal Sa if the value of past pitch lag Lag_old is greater than the threshold value Th, whereby the pulsed signal output from the first algebraic codebook 15$b_1$ is input to the gain multiplier 15*d*. The latter multiplies the input signal by the algebraic codebook gain $\gamma_1$. Further, the algebraic codebook changeover unit 15*f* connects the switch Sw to a terminal Sb if the value of past pitch lag Lag_old is less than the threshold value Th, whereby the pulsed signal output from the first algebraic codebook 15$b_1$, which signal has undergone pitch periodization by the pitch periodizing unit 15*g*, is input to the gain multiplier 15*d*. The latter multiplies the input signal by the algebraic codebook gain $\gamma_1$.

The third embodiment is as set forth above. The number of quantization bits and pulse placements illustrated in this embodiment are examples, and various numbers of quantization bits and various pulse placements are possible. Further, though two encoding modes have been described in this embodiment, three or more modes may be used.

Further, the above description is rendered using two adaptive codebooks. However, since exactly the same past sound-source signals are stored in the two adaptive codebooks, implementation is permissible using one of the adaptive codebooks.

Further, in this embodiment, two weighting filters, two LPC synthesis filters and two error-power evaluation units are used. However, these pairs of devices can be united into single common devices and the inputs to the filters may be switched.

Thus, in accordance with the third embodiment, the number of pulses and pulse placement are changed over adaptively in accordance with the value of past pitch lag, thereby making it possible to perform encoding more precisely in comparison with conventional voice encoding and to obtain high-quality reconstructed speech.

(E) Fourth Embodiment of Voice Encoding Apparatus

Figure 12:
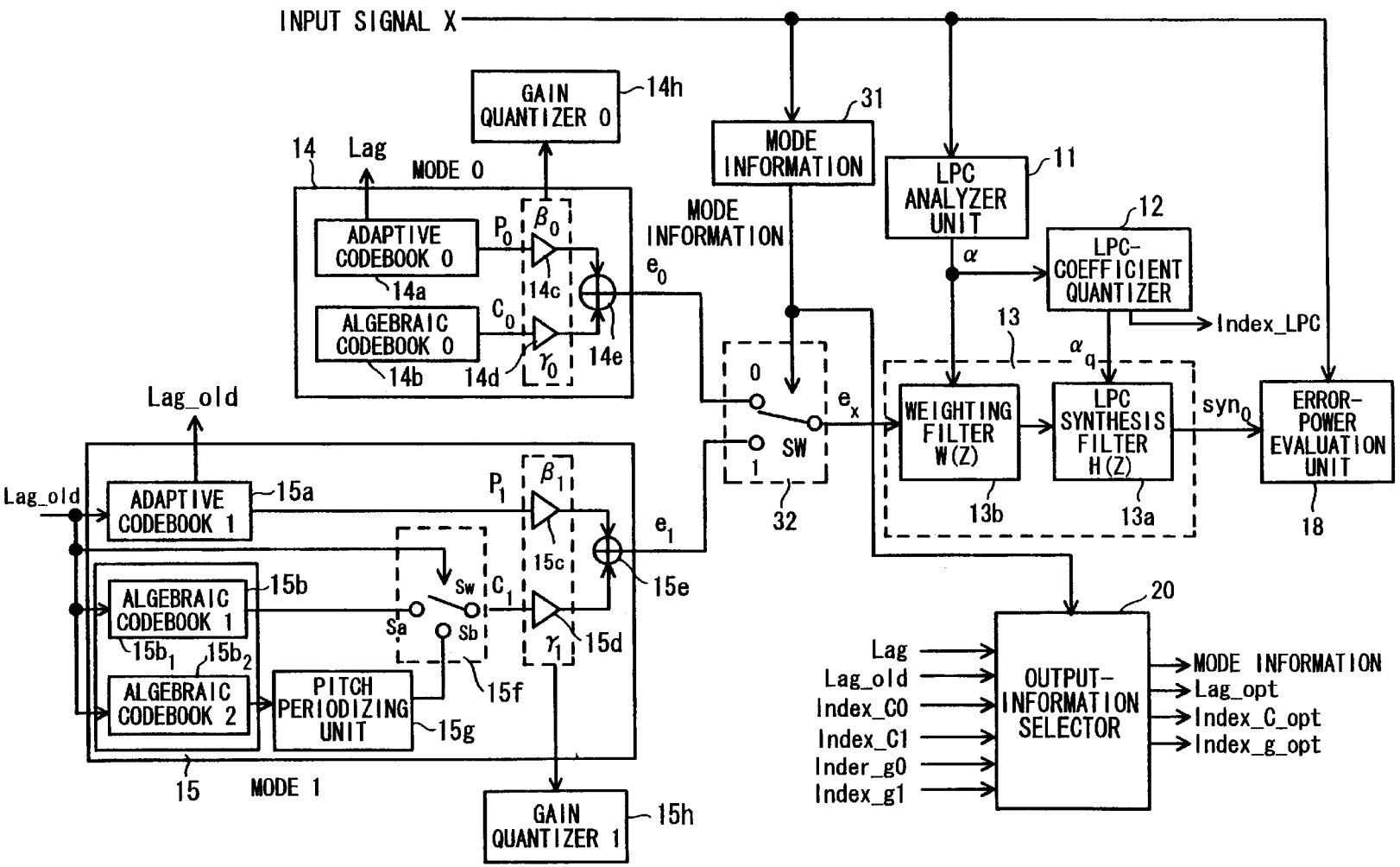
FIG. 12 is a block diagram of a fourth embodiment of an encoding apparatus.

FIG. 12 is a block diagram of a fourth embodiment of a voice encoding apparatus. Here the properties of the input signal are investigated prior to a search, which mode of modes 0, 1 is to be adopted is decided in accordance with these properties, and encoding is performed by conducting the adaptive codebook search/algebraic codebook search in whichever mode has been adopted. The fourth embodiment differs from the third embodiment in that:

(1) the mode decision unit 31 is provided to investigate the properties of the input x before a codebook search and decide which mode to adopt in accordance with the properties of the signal;

(2) the mode-output selector 32 is provided to select the outputs of the encoders 14, 15 conforming to the adopted mode and input the selected output to the weighting filter 13;

(3) the weighting filter [W(z)] 13*b*, LPC synthesis filter [H(z)] 13*a* and error-power evaluation unit 18 are provided in a form shared by each mode; and (4) the output-information selector 20 selects and transmits information, which is sent to the decoder, based upon mode information that enters from the mode decision unit 31.

The mode decision processing executed by the mode decision unit 31 is the same as the processing shown in FIG. 8.

In accordance with the fourth embodiment, in which mode encoding is to be performed is decided based upon the properties of the input signal before a codebook search, encoding is performed in this mode and the result is output. As a result, it is unnecessary to perform encoding in two modes and then select the better result, as is done in the third embodiment. This makes it possible to reduce the amount of processing and enables high-speed processing.

(F) First Embodiment of Decoding Apparatus

Figure 13:
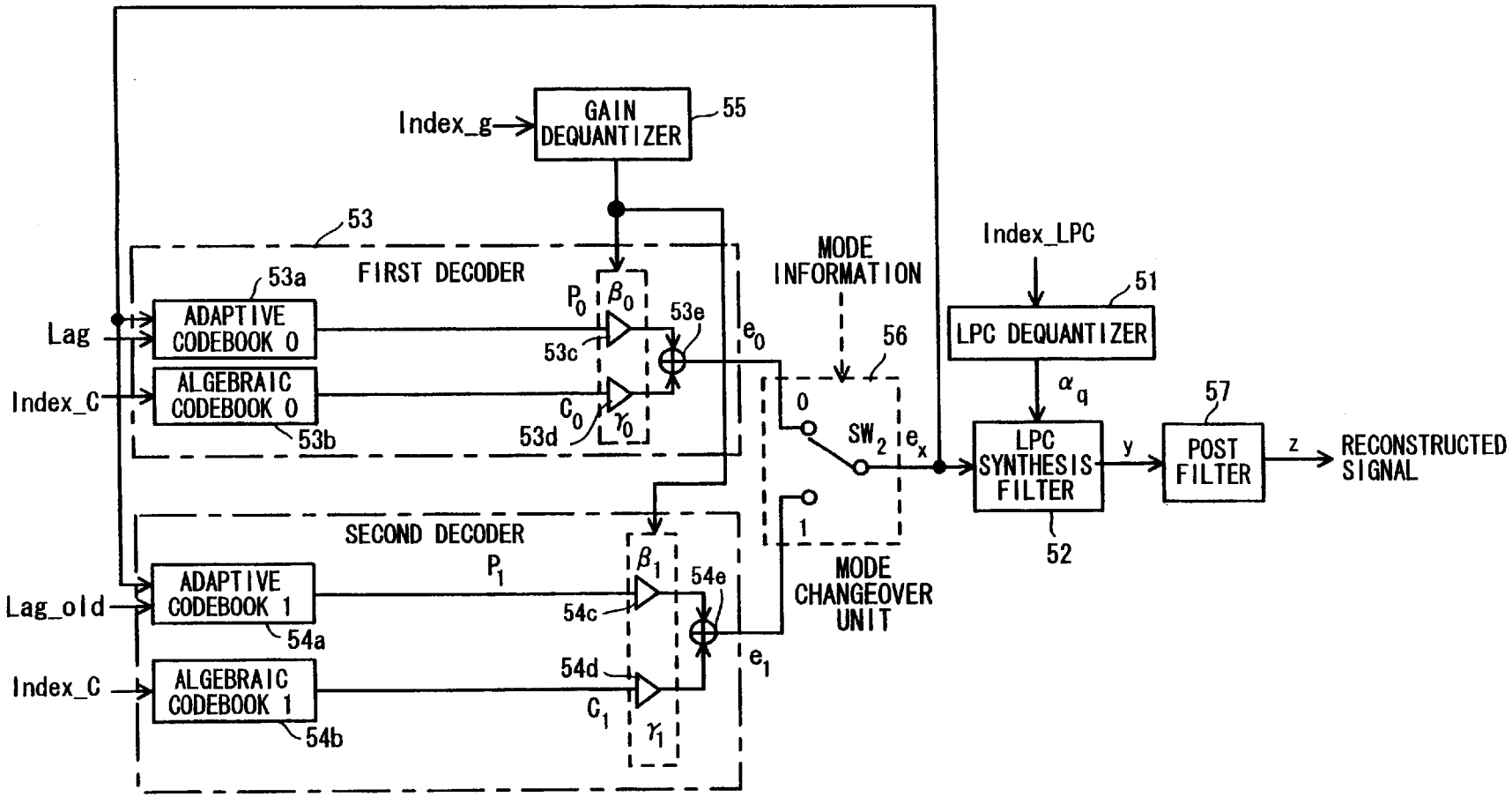
FIG. 13 is a block diagram of a first embodiment of a decoding apparatus.

FIG. 13 is a block diagram of a first embodiment of a voice decoding apparatus. This apparatus generates a voice signal by decoding code information sent from the voice encoding apparatus (of the first and second embodiments).

Upon receiving an LPC quantization index Index_LPC from the voice encoding apparatus, an LPC dequantizer 51 outputs a dequantized LPC coefficient $\alpha_q(i)$ (i=1, 2, . . . , q), where p represents the degree of LPC analysis. An LPC synthesis filter 52 is a filter having a transfer characteristic indicated by the following equation using the LPC coefficient $\alpha_q(i)$:

$$H(z) = \frac{1}{1 + \sum_{i=1}^{p} \alpha_q(i) z^{-i}} \tag{29}$$

A first decoder 53 corresponds to the first encoder 14 in the voice encoding apparatus and includes an adaptive codebook 53*a*, an algebraic codebook 53*b*, gain multipliers 53*c*, 53*d* and an adder 53*e*. The algebraic codebook 53*b* has the pulse placement shown in FIG. 2. A second first decoder 54 corresponds to the second encoder 15 in the voice encoding apparatus and includes an adaptive codebook 54*a*, an algebraic codebook 54*b*, gain multipliers 54*c*, 54*d* and an adder 54*e*. The algebraic codebook 54*b* has the pulse placement shown in FIG. 3.

If the mode information of a received present frame is 0, i.e., if mode 0 is selected in the voice encoding apparatus, the pitch lag Lag enters the adaptive codebook 53*a* of the first decoder and 80 samples of a pitch-period component (adaptive codebook vector) $P_0$ corresponding to this pitch lag Lag are output by the adaptive codebook 53*a*. Further, the algebraic codebook index Index_C enters the algebraic codebook 53*b* of the first decoder and the corresponding noise component (algebraic codebook vector) $C_0$ is output. The algebraic codebook vector $C_0$ is generated in accordance with Equation (21). Furthermore, the gain index Index_g enters a gain dequantizer 55 and the dequantized value $\beta_0$ of pitch gain and dequantized value $\gamma_0$ of algebraic codebook gain enter the multipliers 53*c*, 53*d* from the gain dequantizer 55. As a result, a sound-source signal $e_0$ of mode 0 given by the following equation is output from the adder 53*e:*

$$e_0 = \beta_0 \cdot P_0 + \gamma_0 \cdot C_0 \tag{30}$$

If the mode information of the present frame is 1, on the other hand, i.e., if mode 1 is selected in the voice encoding apparatus, the pitch lag Lag_old of the preceding frame enters the adaptive codebook 54*a* of the second decoder and 80 samples of a pitch-period component (adaptive codebook vector) $P_1$ corresponding to this pitch lag Lag_old are output by the adaptive codebook 54*a*. Further, the algebraic codebook index Index_C enters the algebraic codebook 54*b* of the second decoder and the corresponding noise component (algebraic codebook vector) $C_1(n)$ is generated in accordance with Equation (25). Furthermore, the gain index Index_g enters the gain dequantizer 55 and the dequantized value $\beta_1$ of pitch gain and dequantized value $\gamma_1$ of algebraic codebook gain enter the multipliers 54*c*, 54*d* from the gain dequantizer 55. As a result, a sound-source signal $e_1$ of mode 1 given by the following equation is output from the adder 54*e*.

$$e_1 = \beta_1 \cdot P_1 + \gamma_1 \cdot C_1 \tag{31}$$

A mode changeover unit 56 changes over a switch Sw2 in accordance with the mode information. Specifically, Sw2 is connected to a terminal 0 if the mode information is 0, whereby $e_0$ becomes the sound-source signal ex. If the mode information is 1, then the switch Sw2 is connected to terminal 1 so that $e_1$ becomes the sound-source signal ex. The sound-source signal ex is input to the adaptive codebooks 53*a*, 54*a* to update the content thereof. That is, the sound-source signal of the oldest frame in the adaptive codebook is discarded and the latest sound-source signal ex found in the present frame is stored.

Further, the sound-source signal ex is input to the LPC synthesis filter 52 constituted by the LPC quantization coefficient $\alpha_q(i)$, and the LPC synthesis filter 52 outputs an LPC-synthesized output y. Though the LPC-synthesized output y may be output as reconstructed speech, it is preferred that this signal be passed through a post filter 57 in order to enhance sound quality. The post filter 57 may be of any structure. For example, it is possible to use a post filter in which the transfer function is represented by the following equation:

$$P(z) = \frac{1 + \sum_{i=1}^{10} a_i \bar{\omega}_1^i z^{-i}}{1 + \sum_{i=1}^{10} a_i \bar{\omega}_2^i z^{-i}} (1 - \mu z^{-1}) \quad (32)$$

where $\omega_1$, $\omega_2$, $\mu_1$ are parameters which adjust the characteristics of the post filter. These may take on any values. For example, the following values can be used: $\omega_1$=0.5, $\omega_2$=0.8, $\mu_1$=0.5.

In this embodiment, use of two adaptive codebooks 14*a*, 15*a* is described. However, since exactly the same sound-source signals are stored in the two adaptive codebooks, implementation is permissible using one of the adaptive codebooks.

Thus, in accordance with this embodiment, the number of pulses and pulse placement are changed over adaptively in accordance with the value of past pitch lag, thereby making it possible to obtain reconstructed speech of a quality higher than that of the conventional voice decoding apparatus.

(G) Second Embodiment of Decoding Apparatus

Figure 14:
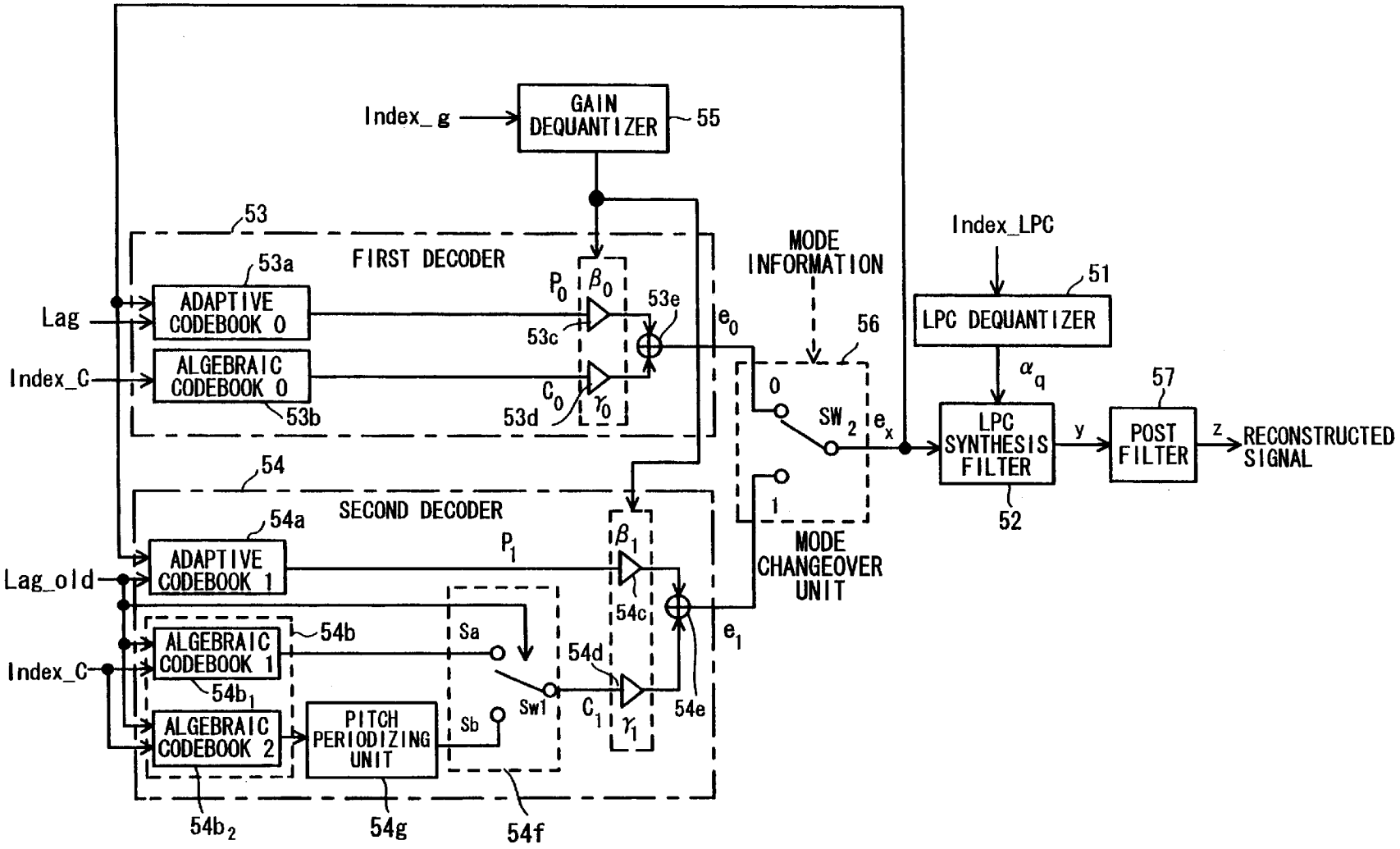
FIG. 14 is a block diagram of a second embodiment of a decoding apparatus.
Figure 15:
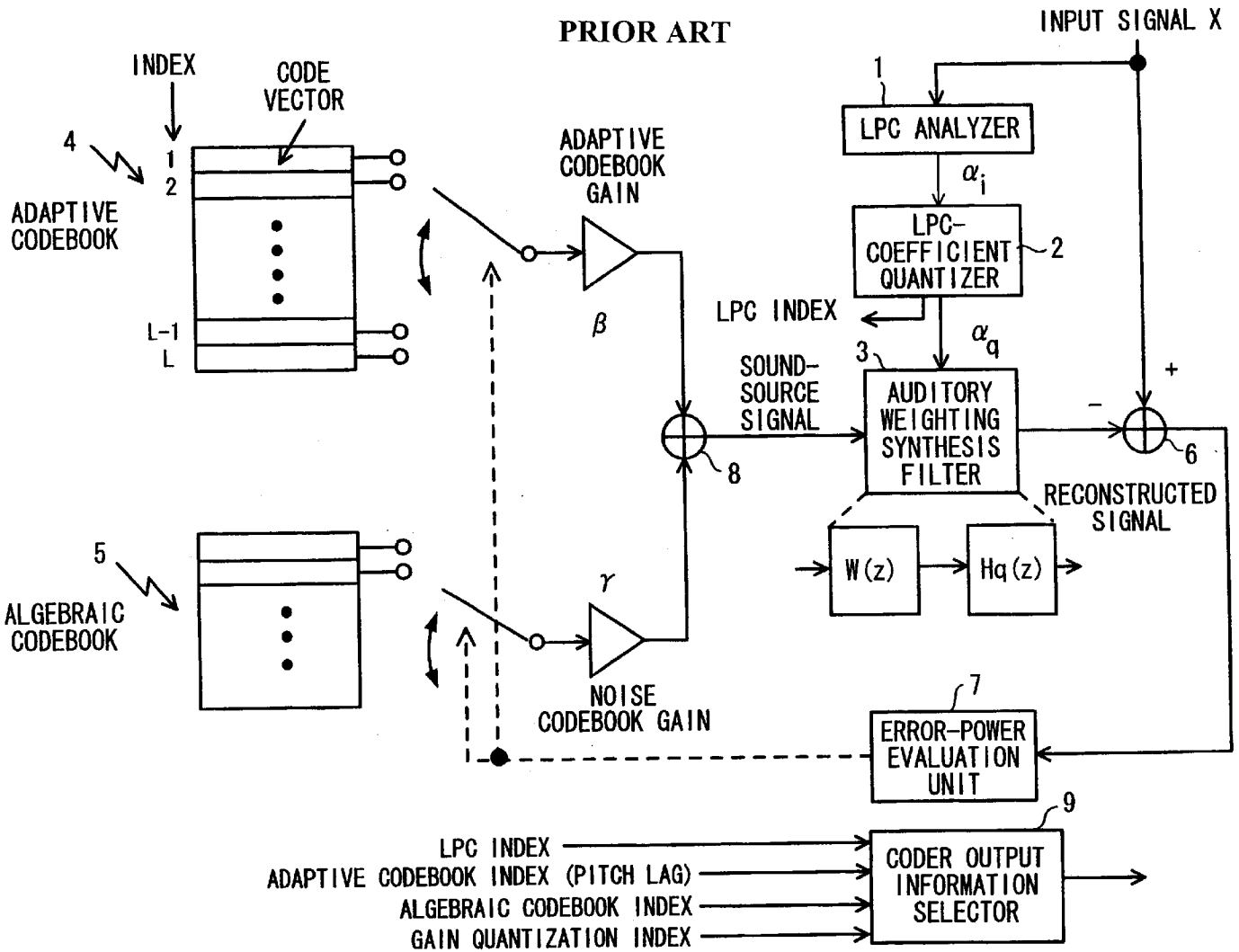
FIG. 15 PRIOR ART
FIG. 15 is a diagram showing the principle of CELP.
Figure 16:
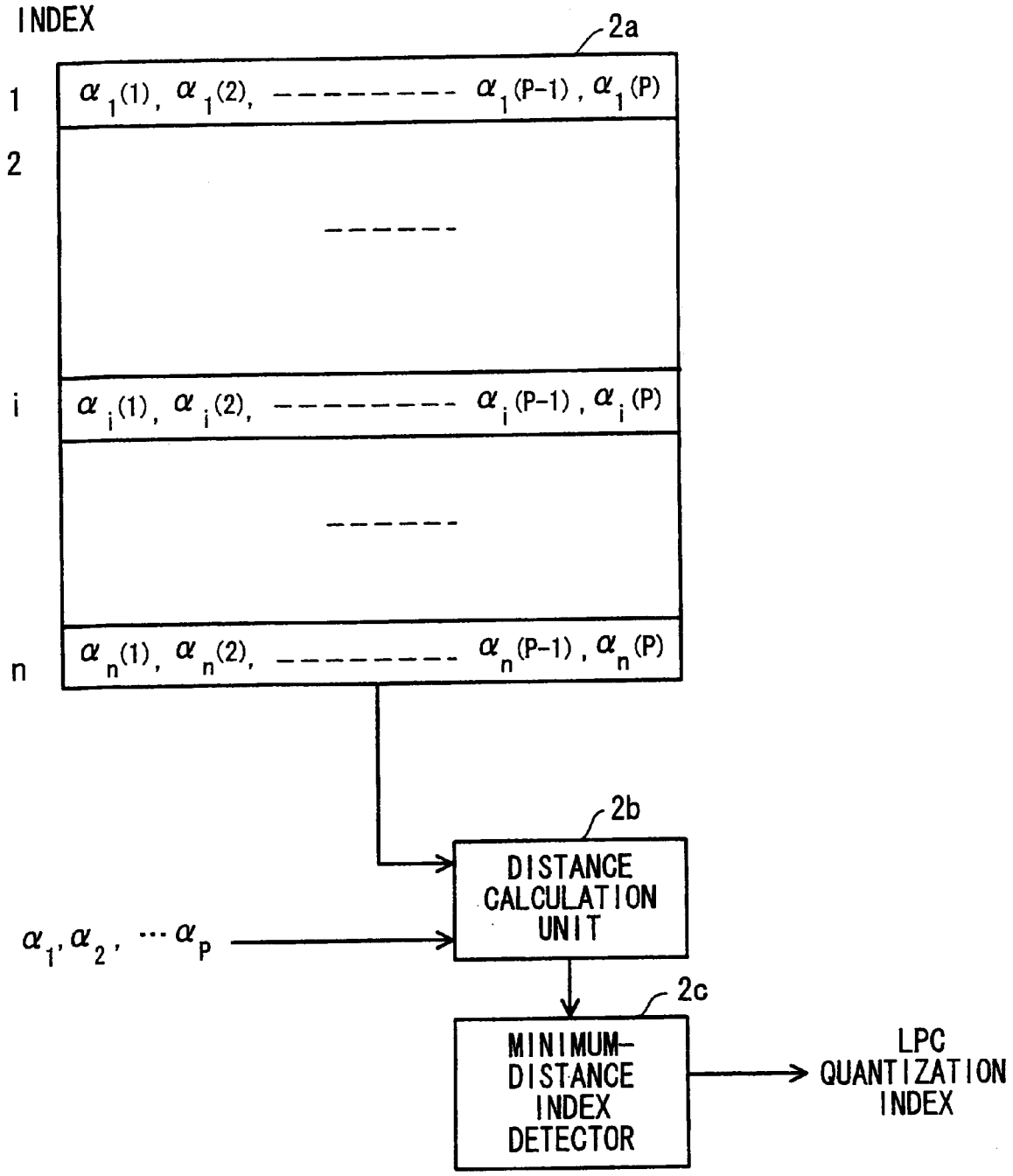
FIG. 16 PRIOR ART
FIG. 16 is a diagram useful in describing a quantization method.

FIG. 14 is a block diagram of a second embodiment of a voice decoding apparatus. This apparatus generates a voice signal by decoding code information sent from the voice encoding apparatus (of the third and fourth embodiments). Components identical with those of the first embodiment in FIG. 13 are designated by like reference characters. This embodiment differs from the first embodiment in that:

(1) a first algebraic codebook 54*b*$_1$ and second algebraic codebook 54*b*$_2$ are provided as the algebraic codebook 54*b*, the first algebraic codebook 54*b*$_1$ has a pulse placement indicated in FIG. 10(*b*), and the second algebraic codebook 54*b*$_2$ has the pulse placement shown in FIG. 10(*c*);

(2) an algebraic codebook changeover unit 54*f* is provided, selects a pulsed signal, which is the noise component output of the first algebraic codebook 54*b*$_1$, if the value Lag_old of pitch lag in the past in mode 1 is greater than a threshold value Th, and selects the pulsed signal output of the second algebraic codebook 54*b*$_2$ if the value Lag_old is less than the threshold value Th; and (3) since second algebraic codebook 54*b*$_2$ places the pulses over a range (sampling points 0 to 55) narrower than that of the first algebraic codebook 54*b*$_1$, a pitch periodizing unit 54*g* is provided and repeatedly generates the noise component (pulsed signal), which is output from the second algebraic codebook 54*b*$_2$, thereby outputting one frame of the pulsed signal.

If the mode information is 0, decoding processing exactly the same as that of the first embodiment is executed. In a case where the mode information is 1, on the other hand, if pitch lag Lag_old of the preceding frame is greater than the predetermined threshold value Th (e.g., 55), the algebraic codebook index Index_C enters the first algebraic codebook 54*b*$_1$ and a codebook output $C_1(n)$ is generated in accordance with Equation (25). If pitch lag Lag_old is less than the predetermined threshold value Th, then the algebraic codebook index Index_C enters the first algebraic codebook 54*b*$_2$ and a codebook output $C_1(n)$ is generated in accordance with Equation (27). Decoding processing identical with that of the first embodiment is thenceforth executed and a reconstructed speech signal is output from the post filter 57.

Thus, in accordance with this embodiment, the number of pulses and pulse placement are changed over adaptively in accordance with the value of past pitch lag, thereby making it possible to obtain reconstructed speech of a quality higher than that of the conventional voice decoding apparatus.

(H) Effects

In accordance with the present invention, there are provided (1) the conventional CELP mode (mode 0), and (2) a mode (mode 1) in which, by using past pitch lag, the pitch-lag information necessary for an adaptive codebook is reduced while the amount of information in an algebraic codebook is increased. As a result, in unsteady segments, such as unvoiced or transient segments, encoding processing the same as that of conventional CELP can be executed, while in steady segments of speech such as voiced segments, the sound-source signal can be encoded precisely by mode 1, thereby making it possible to obtain high-quality reconstructed voice.

What is claimed is:

1. A voice encoding apparatus for encoding a voice signal using an adaptive codebook and an algebraic codebook, comprising:

a synthesis filter implemented using linear prediction coefficients obtained by subjecting an input signal, which is the result of sampling a voice signal at a predetermined speed, to linear prediction analysis in frame units in which each frame is composed of a fixed number of samples (=N);

an adaptive codebook for preserving a pitch-period component of the past L samples of the voice signal and outputting N samples of periodicity signals successively delayed by one pitch;

an algebraic codebook for dividing N sampling points constituting one frame into a plurality of pulse-system groups and, for all combinations obtained by extracting one sampling point from each of the pulse-system groups, successively outputting, as noise components, pulsed signals having a pulse of a positive or negative polarity at each extracted sampling point;

a pitch-lag determination unit for adopting a pitch lag (first pitch lag) as pitch lag of a present frame, wherein this pitch lag specifies a periodicity signal for which the smallest difference will be obtained between said input signal and signals obtained by driving said synthesis filter by the periodicity signals output successively from the adaptive codebook, or for adopting a pitch lag (second pitch lag), found in a past frame, as pitch lag of the present frame;

a pulsed-signal determination unit for determining a pulsed signal for which the smallest difference will be obtained between said input signal and signals obtained by driving said synthesis filter by the periodicity signal specified by the decided pitch lag and the pulsed signals output successively from the algebraic codebook; and signal output means for outputting said pitch lag, data specifying said pulsed signal and said linear prediction coefficients as a voice code.

2. A voice encoding apparatus according to claim 1, wherein when the first pitch lag is adopted as the pitch lag of the present frame, said signal output means outputs said first pitch lag, and when the second pitch lag is adopted as the pitch lag of the present frame, said code output means outputs data to this effect;

said algebraic codebook has a first algebraic codebook used when the first pitch lag is adopted as the pitch lag of the present frame, and a second algebraic codebook used when the second pitch lag is adopted as the pitch lag of the present frame; and the second algebraic codebook has a greater number of pulse-system groups than the first algebraic codebook.

3. A voice encoding apparatus according to claim 2, wherein in that said second algebraic codebook has:

a third algebraic codebook for dividing N sampling points constituting one frame into a plurality of pulse-system groups and, for all combinations obtained by extracting one sampling point from each of the pulse-system groups, successively outputting, as noise components, pulsed signals having a pulse of a positive or negative polarity at each extracted sampling point; and a fourth algebraic codebook for dividing M sampling points, which are contained in a period of time shorter than the duration of one frame, into a number of pulse-system groups greater than that of the third algebraic codebook and, for all combinations obtained by extracting one sampling point from each of the pulse-system groups, successively outputting, as noise components, pulsed signals having a pulse of a positive or negative polarity at each extracted sampling point;

said pulsed-signal determination unit uses the third algebraic codebook when the value of said second pitch lag is greater than M and uses the fourth algebraic codebook when the value of the second pitch lag is less than M.

4. A voice encoding apparatus according to claim 1, wherein further comprising a pitch-lag selector for selecting said first pitch lag or said second pitch lag as the pitch lag of the present frame in dependence upon properties of the input signal.

5. A voice encoding apparatus according to claim 4, wherein said selector finds a time difference between the input signal of the present frame and a past input signal for which an autocorrelation value is maximized, discriminates periodicity of the input signal on the basis of the time difference, selects the second pitch lag as the pitch lag of the present frame if the periodicity is high and selects the first pitch lag as the pitch lag of the present frame if the periodicity is low.

6. A voice encoding apparatus according to claim 1, wherein further comprising a pitch-lag selector for comparing a difference between the input signal and the signal which is output from the synthesis filter and prevailing when the first pitch lag is used and a difference between the input signal and the signal which is output from the synthesis filter prevailing when the second pitch lag is used, and adopting the pitch lag for which the difference is smaller as the pitch lag of the present frame.

7. A voice encoding method for encoding a voice signal using an adaptive codebook and an algebraic codebook, wherein comprising:

obtaining linear prediction coefficients by subjecting an input signal, which is the result of sampling a voice signal at a predetermined speed, to linear prediction analysis in frame units in which each frame is composed of a fixed number of samples (=N), and constructing a synthesis filter using said linear prediction coefficients;

providing an adaptive codebook for preserving a pitch-period component of the past L samples of the voice signal and successively outputting N samples of periodicity signals delayed by one pitch;

providing a first algebraic codebook for dividing N sampling points constituting one frame into a plurality of pulse-system groups and, for all combinations obtained by extracting one sampling point from each of the pulse-system groups, successively outputting, as noise components, pulsed signals having a pulse of a positive or negative polarity at each extracted sampling point, and a second algebraic codebook for dividing the sampling points into a number of pulse-system groups greater than that of the first algebraic codebook and, for all combinations obtained by extracting one sampling point from each of the pulse-system groups, successively outputting pulsed signals having a pulse of a positive or negative polarity at each extracted sampling point;

adopting, as pitch lag of the present frame, a pitch lag that specifies a periodicity signal for which the smallest difference will be obtained between said input signal and signals obtained by driving said synthesis filter by N samples of periodicity signals obtained from the adaptive codebook upon being successively delayed by one pitch, and specifying a pulsed signal for which the smallest difference (first difference) will be obtained between said input signal and signals obtained by driving said synthesis filter by the periodicity signal specified by the said pitch lag and the pulsed signals output successively from the first algebraic codebook;

adopting a pitch lag, found in a past frame, as pitch lag of the present frame, and specifying a pulsed signal for which the smallest difference (second difference) will be obtained between said input signal and signals obtained by driving said synthesis filter by the periodicity signal specified by said pitch lag and the pulsed signals output successively from the second algebraic codebook; and outputting, as voice code, the pitch lag and data specifying said pulse signal for whichever of said first and second differences is smaller, and said linear prediction coefficients.

8. A voice encoding method according to claim 7, wherein said second algebraic codebook has:

a third algebraic codebook for dividing N sampling points constituting one frame into a plurality of pulse-system groups and, for all combinations obtained by extracting one sampling point from each of the pulse-system groups, successively outputting, as noise components, pulsed signals having a pulse of a positive or negative polarity at each extracted sampling point; and a fourth algebraic codebook for dividing M sampling points, which are contained in a period of time shorter than the duration of one frame, into a number of pulse-system groups greater than that of the third algebraic codebook and, for all combinations obtained by extracting one sampling point from each of the pulse-system groups, successively outputting, as noise components, pulsed signals having a pulse of a positive or negative polarity at each extracted sampling point; and the third algebraic codebook is used when the value of said second pitch lag is greater than M, and the fourth algebraic codebook is used when the value of the second pitch lag is less than M, and a pulsed signal is specified so that said second difference is smallest.

9. A voice encoding method for encoding a voice signal using an adaptive codebook and an algebraic codebook, wherein comprising:

obtaining linear prediction coefficients by subjecting an input signal, which is the result of sampling a voice signal at a predetermined speed, to linear prediction analysis in frame units in which each frame is composed of a fixed number of samples (=N), and constructing a synthesis filter using said linear prediction coefficients;

providing an adaptive codebook for preserving a pitch-period component of the past L samples of the voice signal and successively outputting N samples of periodicity signals delayed by one pitch;

providing a first algebraic codebook for dividing N sampling points constituting one frame into a plurality of pulse-system groups and, for all combinations obtained by extracting one sampling point from each of the pulse-system groups, successively outputting, as noise components, pulsed signals having a pulse of a positive or negative polarity at each extracted sampling point, and a second algebraic codebook having a greater number of pulse-system groups than the first algebraic codebook;

(1) if periodicity of the input signal is low, obtaining a pitch lag that specifies a periodicity signal for which the smallest difference will be obtained between said input signal and signals obtained by driving said synthesis filter by N samples of periodicity signals obtained from the adaptive codebook upon being successively delayed by one pitch;

specifying a pulsed signal for which the smallest difference will be obtained between said input signal and signals obtained by driving said synthesis filter by the periodicity signal specified by said pitch lag and the pulsed signals output successively from the first algebraic codebook; and outputting said pitch lag, data specifying said pulsed signal and said linear prediction coefficients as a voice code; and (2) if periodicity of the input signal is high, adopting a pitch lag, found in a past frame, as pitch lag of the present frame;

specifying a pulsed signal for which the smallest difference will be obtained between said input signal and signals obtained by driving said synthesis filter by the periodicity signal specified by said pitch lag and the pulsed signals output successively from the second algebraic codebook; and outputting data indicating that pitch lag is identical with past pitch lag, data specifying said pulsed signal and said linear prediction coefficients as a voice code.

10. A voice coding method according to claim 9, wherein said second algebraic codebook has:

a third algebraic codebook for dividing N sampling points constituting one frame into a plurality of pulse-system groups and, for all combinations obtained by extracting one sampling point from each of the pulse-system groups, successively outputting, as noise components, pulsed signals having a pulse of a positive or negative polarity at each extracted sampling point; and a fourth algebraic codebook for dividing M sampling points, which are contained in a period of time shorter than the duration of one frame, into a number of pulse-system groups greater than that of the third algebraic codebook and, for all combinations obtained by extracting one sampling point from each of the pulse-system groups, successively outputting, as noise components, pulsed signals having a pulse of a positive or negative polarity at each extracted sampling point; and the third algebraic codebook is used when the value of said second pitch lag is greater than M, and the fourth algebraic codebook is used when the value of the second pitch lag is less than M, and a pulsed signal is specified so that said second difference is smallest.

11. A voice encoding method having a synthesis filter implemented using linear prediction coefficients obtained by dividing an input signal into frames each of a fixed length, and subjecting the input signal to linear prediction analysis in the frame units, generating a reconstructed signal by driving said synthesis filter by a periodicity signal output from an adaptive codebook and a pulsed signal output from an algebraic codebook, and performing encoding in such a manner that an error between the input signal and said reproduced signal is minimized, comprising:

providing an encoding mode 1 that uses pitch lag obtained from an input signal of a present frame and an encoding mode 2 that uses pitch lag obtained from an input signal of a past frame;

encoding in accordance with the encoding mode 1 and encoding mode 2 and deciding, frame by frame, the mode in which the input signal can be encoded more precisely; and adopting the result of the encoding based upon the mode decided.

12. A voice encoding method having a synthesis filter implemented using linear prediction coefficients obtained by dividing an input signal into frames each of a fixed length, and subjecting the input signal to linear prediction analysis in the frame units, generating a reconstructed signal by driving said synthesis filter by a periodicity signal output from an adaptive codebook and a pulsed signal output from an algebraic codebook, and performing encoding in such a manner that an error between the input signal and said reproduced signal is minimized, comprising:

providing an encoding mode 1 that uses pitch lag obtained from an input signal of a present frame and an encoding mode 2 that uses pitch lag obtained from an input signal of a past frame;

deciding an optimum mode in accordance with properties of the input signal; and performing encoding based upon the mode decided.

13. A voice decoding apparatus for decoding a voice signal using an adaptive codebook and an algebraic codebook, comprising:

a synthesis filter implemented using linear prediction coefficients received from an encoding apparatus;

an adaptive codebook for preserving a pitch-period component of the past L samples of the decoded voice signal and outputting a periodicity signal indicated by pitch lag received from the encoding apparatus or by pitch lag found from information to the effect that pitch lag is the same as in the past;

an algebraic codebook for outputting, as a noise component, a pulsed signal indicated by received data specifying a pulsed signal; and means for combining, and inputting to said synthesis filter, the periodicity signal output from the adaptive codebook and the pulsed signal output from the algebraic codebook, and outputting a reproduced signal from said synthesis filter.

14. A voice decoding apparatus according to claim 13, wherein said algebraic codebook includes a first algebraic codebook and a second algebraic codebook having a greater number of pulse-system groups than the first algebraic codebook;

if the pitch lag is received from the encoding apparatus, then the first algebraic codebook outputs a pulsed signal indicated by the received data specifying the pulsed signal; and if the information to the effect that pitch lag is the same as in the past is received from the encoding apparatus, then the second algebraic codebook outputs a pulsed signal indicated by the received data specifying the pulsed signal.

15. A voice decoding apparatus according to claim 14, wherein said second algebraic codebook includes:

a third algebraic codebook for dividing N sampling points constituting one frame into a plurality of pulse-system groups and, for all combinations obtained by extracting one sampling point from each of the pulse-system groups, outputting, as noise components, pulsed signals having a pulse of a positive or negative polarity at each extracted sampling point; and a fourth algebraic codebook for dividing M sampling points, which are contained in a period of time shorter than the duration of one frame, into a number of pulse-system groups greater than that of the third algebraic codebook and, for all combinations obtained by extracting one sampling point from each of the pulse-system groups, outputting, as noise components, pulsed signals having a pulse of a positive or negative polarity at each extracted sampling point;

if the information to the effect that pitch lag is the same as in the past has been received from the encoding apparatus, then, when the pitch lag is greater than M, the third algebraic codebook outputs the pulsed signal indicated by the received data specifying the pulsed signal, and when the pitch lag is less than M, the fourth algebraic codebook outputs the pulsed signal indicated by the received data specifying the pulsed signal.

* * * * *